US006671971B2

(12) United States Patent
Albert

(10) Patent No.: US 6,671,971 B2
(45) Date of Patent: Jan. 6, 2004

(54) BOWLING BALL ANGULATOR AND METHODS OF USE

(76) Inventor: David M. Albert, 8404 E. Otero Cir., Denver, CO (US) 80112

( * ) Notice: Subject to any disclaimer, the term of this patent is extended or adjusted under 35 U.S.C. 154(b) by 0 days.

(21) Appl. No.: 10/423,719

(22) Filed: Apr. 25, 2003

(65) Prior Publication Data

US 2003/0196341 A1 Oct. 23, 2003

Related U.S. Application Data

(62) Division of application No. 09/873,111, filed on May 31, 2001.

(51) Int. Cl.[7] ..... G01B 5/00

(52) U.S. Cl. ..... 33/509; 33/510; 473/125

(58) Field of Search ..... 33/509, 510, 666, 33/669, 670, 671, 672, 673, 674, 677, 678, 679; 473/125, 128, 129

(56) References Cited

U.S. PATENT DOCUMENTS

| | | | | |
|---|---|---|---|---|
| 2,706,338 A | | 4/1955 | Ackerman et al. | |
| 3,096,586 A | | 7/1963 | Albright et al. | |
| 3,145,479 A | * | 8/1964 | Rassner | 33/510 |
| 3,161,041 A | | 12/1964 | Amburgey | |
| 3,875,668 A | | 4/1975 | Taylor | |
| 4,257,165 A | * | 3/1981 | Ellison | 33/510 |
| 5,042,163 A | | 8/1991 | Sposato | |
| 5,603,165 A | | 2/1997 | Bernhardt et al. | |
| 5,732,474 A | | 3/1998 | Cannon | |
| 5,813,129 A | | 9/1998 | Tseng | |
| 2002/0011005 A1 | | 1/2002 | Takahashi | |

OTHER PUBLICATIONS

Photograph A depicting the JAYHAWK 2–IN–1 Layout tool, available at least as early as the filing date.
Photograph B depicting a different view of Photograph A, available at least as early as the filing date.
Photograph C depicting contact information for the Pro Sect by Turbo 2–N–1 Grips, available at least as early as the filing date.
Photograph D depicting the Pro Sect of Figure C, available at least as early as the filing date.

(List continued on next page.)

*Primary Examiner*—Diego Gutierrez
*Assistant Examiner*—T Courson
(74) *Attorney, Agent, or Firm*—Dorsey & Whitney LLP

(57) ABSTRACT

A device for locating bowling ball gripping apertures with respect to a bowling ball weight block angle inherent to that particular bowling ball and the track of a particular bowler. One embodiment of the device includes a curved base portion adapted to substantially rest on a curved surface of a bowling ball, the perimeter of the base portion including degree indicators and the center of the base portion including a hole, at least four curved angle indicator arms adapted to substantially rest on a curved surface of the bowling ball, the angle indicator arms including length measurement indicators, the angle indicator arms connected with and extending from the curved base portion, and at least two of the angle indicator arms are adapted to rotate about the center of the curved base portion. Methods for both diagnostically measuring the location of the gripping holes on a drilled bowling ball relative to the block angle and pin distance to the positive access point and for laying out the placement of gripping holes on an undrilled bowling ball relative to a desired weight block angle and pin to positive access point distance for a particular bowler's track. A device for both measuring and duplicating the thumb hole angle on drilled and undrilled bowling balls, respectively.

15 Claims, 15 Drawing Sheets

OTHER PUBLICATIONS

Photograph E depicting the Pro Sect of Figure C, available at least as early as the filing date.

Photograph F depicting the Pro Sect of Figure C, available at least as early as the filing date.

"Creating a Brighter Future for Bowling" brochure advertisement by Turbo 2N–1 Grip Merchandising, undated, but available at least as early as the filing date.

"Hammer Drilling Suggestions: Precision, Quick Reference, Full Roller for Sledge Hammer & 3–D Offset Hammer Balls" brochure, Hammer, undated, but available at least as early as the filing date.

"Columbia Drilling Sheet" brochure, Columbia 300, undated, but available at least as early as the filing date.

"Pro Shop Operator's Guide to AMF Ball Drilling Techniques" brochure, AMF Bowling Products, 1997.

"Angle Evolution Drilling Instructions" brochure, AMF Bowling, Inc., 1998.

"Bowling Equipment Concepts Equipment Glossary (Revised–Dec.–99)", copyright by Denny Torgerson 1998.

*Bowling This Month*, "Tech Talk with Ball Designer Mo Pinel," Aug., 2000, pp. 40–41.

* cited by examiner

BOWLING BALL ANGULATOR AND METHODS OF USE

CROSS REFERENCE TO RELATED APPLICATION

This application is a divisional application of U.S. patent application Ser. No. 09/873,111 filed on May 31, 2001. The above identified application is hereby incorporated by reference as if fully disclosed herein.

FIELD OF THE INVENTION

This invention relates to bowling accessories, and more specifically to a device used for the following: locating a bowler's positive axis point (PAP) on a particular drilled or undrilled bowling ball; diagnostically measuring a drilled bowling ball's weight block angulation (providing the weight block is a two-piece style weight block) relative to the bowler's track and PAP; and locating a bowler's grip center on an undrilled bowling ball relative to any desired weight block angulation and relative to a bowler's track.

The present invention can also be used to measure special thumb hole angles in a drilled bowling ball thumb hole in a bowler's grip. For example, if the bowler uses an oval shaped thumb hole in the ball grip, the invention can measure the angle of the thumb hole with respect to the center-line of the grip. The present invention device can also be used to duplicate a measured thumb hole angle on drilled bowling balls using a thumb insert or undrilled balls using an oval shaped thumb hole.

BACKGROUND OF THE INVENTION

In the sport of bowling, aside from the technique of the bowler, one of the key factors that determines how a ball rolls down the lane is the location of a bowler's grip on the bowling ball relative to the bowling ball's weight block angulation with respect to the bowler's track. Therefore, the location of the bowler's track in relation to the location of a weight block internal to the bowling ball significantly impacts the rolling dynamics of the bowling ball.

In the known art, bowling balls are typically laid out by skilled pro-shop employees using artful methods and techniques. Laying out a bowling ball means the positioning of the finger holes with respect to the physical parameters of the ball, such as the block, pins, center of gravity, among other features. Multiple tools including straight edges, protractors, and right angles are used to lay out a ball. In addition, there is currently no known device for precisely angulating the two-piece style weight block in the modern bowling ball relative to the bowler's track. For example, a 45 degree angle block to bowler's track will have different rolling dynamics than a 135 degree angle block to the same bowler's track provided that the bowling balls are identical in all other ways (i.e., surface composition and weight block shape).

The present invention device provides a simpler and more accurate way to layout currently accepted layout designs. One layout currently used on bowling balls is the 4"×4" layout. In the 4"×4" layout, the positive axis point is located four inches from both the pin and the center of gravity. The preferred way by pro shops to provide a ball with a 4"×4" layout is to use a protractor to draw 4" radius arcs around both the pin and the center of gravity. The positive axis point is then located on any points where the two arcs intersect. The present invention eliminates the need for a protractor thereby both simplifying and increasing the accuracy for current layout designs and the methods used to create those designs.

Bowling ball thumb holes may be oval in shape and placed on the bowling ball at a skewed angle in relation to the grip center-line. Currently, there is no known device or method for precisely duplicating the thumb hole angle of a first bowling ball thumb hole to the thumb hole angle of a second bowling ball thumb hole other than a special drill press.

There is a need for a device and method for both increasing the precision and simplifying the process of laying out the gripping holes on a bowling ball for a desired weight block angulation to the particular bowler's track. There is a need for a device that allows for the precise duplication of a first bowling ball's rolling dynamics to a second bowling ball (i.e., duplicating a 45° weight block angle in the second bowling ball). There is a need for a device that allows one to quickly find a bowler's PAP. There is a need for a device that allows one to find the weight block angle of a particular bowling ball relative to the bowler's track. There is a need for a device that can measure the thumb hole angle of a drilled bowling ball. There is a need for a device that allows for the duplication of a first bowling ball's thumb hole angle to a second bowling ball without using a special drill press.

SUMMARY OF THE INVENTION

The present invention bowling ball angulator device both simplifies and increases the precision of the process for laying out the gripping holes on a bowling ball for a specific bowling ball rolling dynamics ball reaction. The present invention bowling ball angulator device and the methods of using the device disclosed herein can be used diagnostically to easily determine a bowler's positive axis point (PAP) and to allow one to precisely determine the layout of a first drilled bowling ball grip with respect to the bowling ball's weight block location relative to the bowler's track.

This information, in turn, can be used to duplicate the rolling dynamics of the first bowling ball to a second bowling ball by laying out the grip of the second ball the same as the grip of the first ball with respect to the weight block's internal to both balls relative to the same bowler's track.

The present invention bowling ball angulator device and methods of using the device disclosed herein can also be used for precisely measuring the thumb hole angle of a first bowling ball thumb hole and using the information to duplicate the first thumb hole angle on a second ball's thumb hole. The present invention device can be used to determine the proper thumb hole angulation of a particular bowling ball.

One embodiment of the present invention device includes a curved base portion that is adapted to at least partially rest on the curved surface of the bowling ball. The perimeter of the base portion includes degree indicators, and the center of the base portion includes a hole. At least four curved angle indicator arms that are adapted to at least partially rest on the curved surface of the bowling ball extends from the curved base portion. The angle indicator arms include length measurement indicators. At least two of the angle indicator arms are adapted to rotate about the center of the curved base portion.

Other embodiments of the present invention angulator device include an embodiment having a substantially open base portion, an embodiment having only three angle indicator arms, and an embodiment including a substantially smaller base portion.

Further embodiments of the present invention include various methods for both diagnostically measuring the location of the bowling ball gripping holes with respect to the bowling ball weight block relative to the bowler's track and laying out the placement of the bowling ball gripping holes on a new undrilled bowling ball.

The invention is embodied in a device for laying out a bowling ball, the device including a base portion having a center adapted to substantially rest on a curved surface of a bowling ball, the perimeter of said base portion including degree indicators; at least four arms adapted to substantially rest on the curved surface of a bowling ball, said arms including length measurement indicators, said angle indicator arms connected with and extending from said base portion; wherein at least two of said angle indicator arms are adapted to rotate about the center of said curved base portion.

Additionally, the invention is also embodied in a device for laying out a bowling ball, said device including a base portion having a center adapted to substantially rest on a curved outer surface of a bowling ball; at least one arm adapted to extend along the curved surface of the bowling ball, said arm connected with and extending from the base portion; and wherein said other arm is adapted to rotate about the center of said base portion.

The inventive device can be used to determine many different physical characteristics of a bowling ball, as well as assist in the layout of the bowling ball in a quick, accurate and repeatable manner.

Other aspects, features and details of the present invention can be more completely understood by reference to the following detailed description of a preferred embodiment, taken in conjunction with the drawings and from the appended claims.

DETAILED DESCRIPTION OF THE PREFERRED EMBODIMENT

Figure 30:
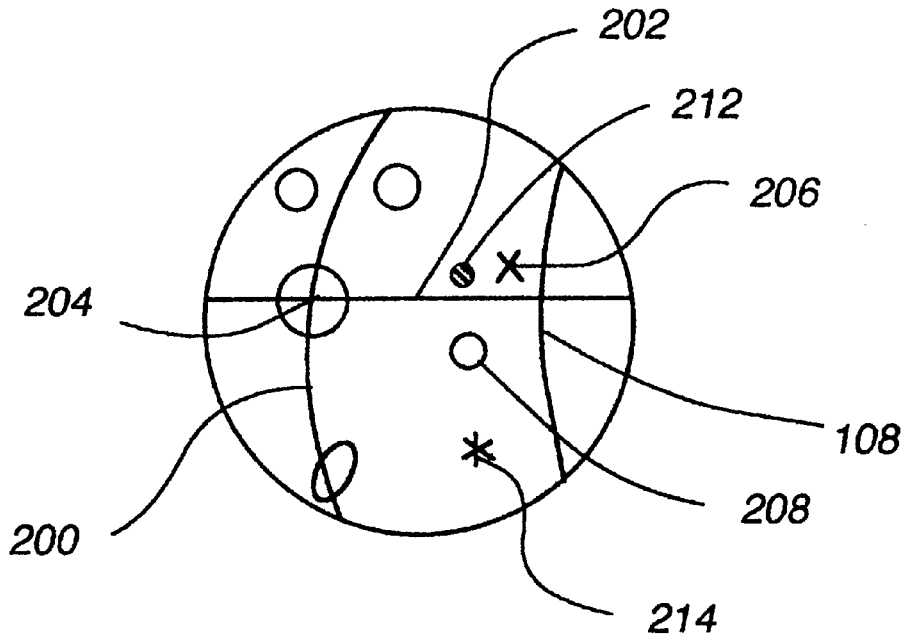
Fig. 30 Prior Art
FIG. 30 illustrates the location of the common elements of a prior art bowling ball as described in the background section herein.
Figure 31:
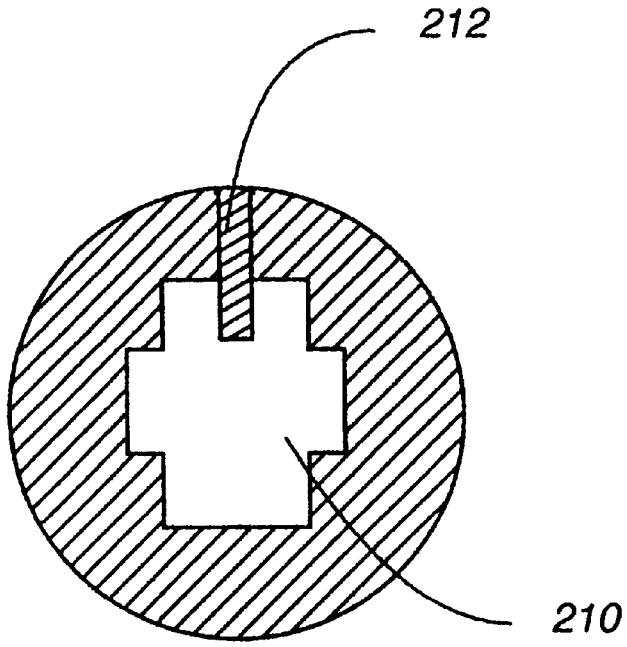
Fig. 31 Prior Art
FIG. 31 illustrates the location of the pin and the weight block in a prior art bowling ball as described in the background section herein.

Definitions:

The sport of bowling and particularly the art and science of manufacturing and drilling bowling balls includes its own vocabulary. The following provides definitions of common bowling terms used herein (see FIGS. 30–31).

The "centerline" (CL) 200 (see FIG. 30) of the grip is a vertical line that passes between the finger holes and through the center of the thumb hole.

The "center of gravity" (CG) 208 of a bowling ball is a mark on the surface of the ball that indicates the position of the center of mass of the whole ball relative to the geometric center of the ball.

The "grip" or "gripping holes" of a bowling ball consists of either the finger holes and thumb hole drilled on the bowling ball or in some cases only the finger holes (and no thumb hole).

The "grip center" (GC) 204 is located at the intersection of the midline and the centerline of the grip. For a grip that includes both finger holes and a thumb hole, GC 204 lies at the midpoint of a line that runs along CL 200 from the center of the thumb hole to the perpendicular line (to CL 200) that runs through the center of both finger holes. If no thumb hole is included in the grip, GC 204 lies at the midpoint of the perpendicular line (to CL 200) that runs through the center of both finger holes.

The "mass bias" (MB) 214 of a bowling ball is a mark on the surface of the ball that indicates the position of the center of mass of the positive half of the core on a pin-out ball. The pin distance to MB 214 is routinely 6.75 inches or half-way around the ball. Balls only have a MB 214 if the weight block is asymmetrical or heavier on one-half of the weight block than the other half. Therefore, not all balls have a mass bias.

The "midline" (ML) 202 is a horizontal line that passes midway between the inside edge of the thumb hole and the inside edge of the finger holes and is perpendicular to the centerline of the grip.

The "pin" 212 of a bowling ball is a mark on the surface of the ball that indicates the position of the top of the core, or the position of the weight block 210, inside the ball. A ball is called a "pin in" ball if the pin is 1–2 inches away from CG 208 and a "pin out" ball if the pin is greater than 2 inches from CG 208. It has been found that the greater the pin 212 distance from PAP 206, the further down the lane the ball will travel before gripping the lane.

A bowler's "positive axis point" (PAP) 206 on a bowling ball refers to the positive end of the bowler's axis of rotation during the ball's first revolution after it hits the lane. The location of PAP 206 is expressed in terms of horizontal and vertical coordinates with respect to the grip center and the midline.

The ball "track" 108 (see FIG. 15) is the line defined of the ball created by the contact of the ball with the base when the ball is thrown down the lane. This track is often defined by a line of oil picked up by the ball; and is unique to the bowler. A bowler's track 108 relates to the level and technique of the bowler. The device and methods described herein are all used in relation to a bowler's track 108.

The "weight block" 210 of a bowling ball refers to the inner core in two-piece bowling balls. The average non-bowler or occasional recreation bowler does not realize that most bowling balls are not fabricated to be a homogenous body of material. A typical bowling ball includes a weight block 210 located under the surface of the ball and toward the center of the ball.

The CG 208, MB 214, and pin 212 locations are very important in terms of location relative to the bowler's track and the rolling dynamics of the bowling ball.

Figure 18:
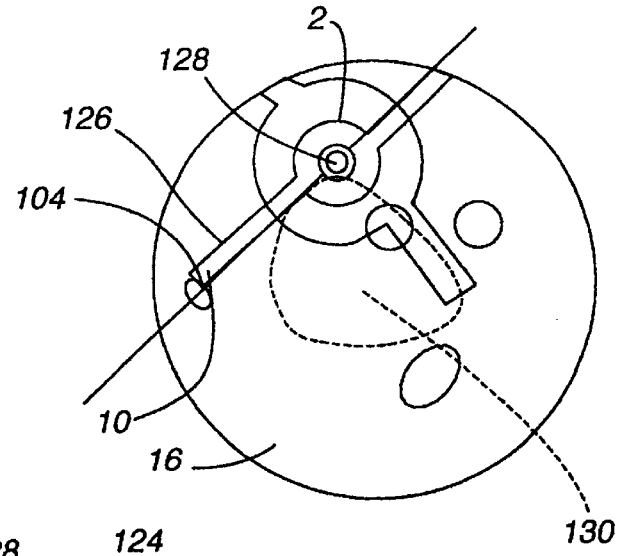
FIG. 18 illustrates a method of measuring the pin distance to the PAP of a drilled bowling ball using the angulator device.

FIGS. 1–4 illustrate the preferred embodiment of a bowling ball angulator device. As illustrated in FIGS. 1A–1B, the angulator device 2 is comprised of a central cap-like base portion 4 with multiple arms 6, 8, 10, and 12 extending therefrom. The multiple arms extend approximately halfway down the bowling ball circumference as illustrated in FIG. 18. At the center of the base portion 4, is a hole 14 that allows the user to see and contact the surface of the bowling ball 16 beneath.

Figure 1A:
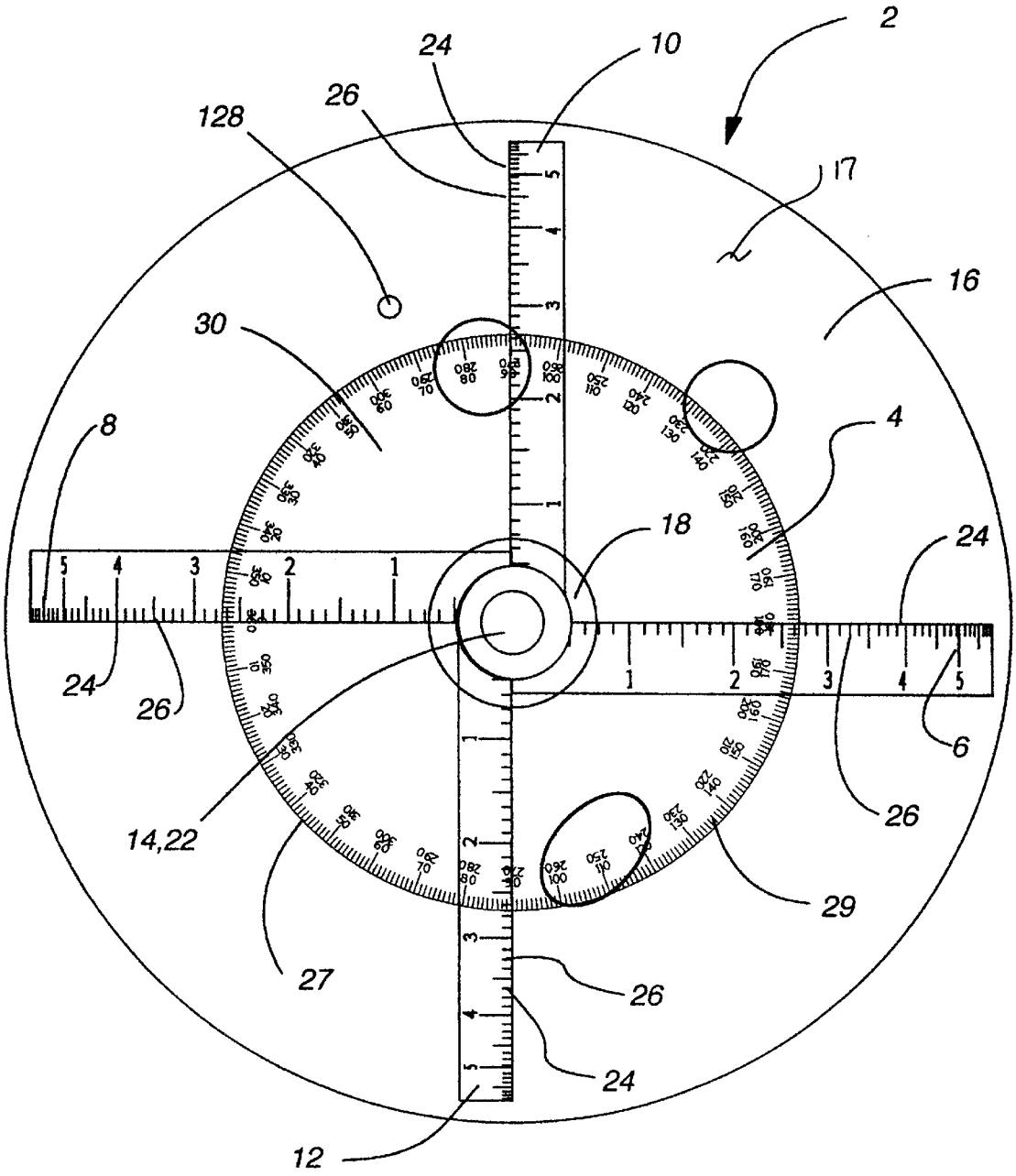
FIG. 1A is a top plan view of one embodiment of the angulator device centered over a bowling ball.

In one embodiment, two of the extending arms 6, 8 remain in a fixed position with respect to the center of the base portion 4 and can be integral to the base portion. In FIG. 1A, the fixed angle indicator arms 6, 8 are positioned at three and nine o'clock, respectively. The other two indicator arms 10, 12 are adjustable relative to the base portion and can rotate around the base portion.

The adjustable angle indicator arms 10, 12 are illustrated at twelve and six o'clock, respectively, in FIG. 1A and extend substantially the same distance down the surface of the bowling ball 16 as the fixed indicator arms 6, 8. The adjustable angle indicator arms 10, 12 rotate about the center 14 of the base portion 4. The adjustable angle indicator arms 10, 12 are attached with a disk-shaped top portion 18 that is in axial alignment with the base portion 4. In this embodiment, the adjustable arms are in a fixed relationship to one another. In this instance they are fixed at approximately 180° from one another. The top portion 18 includes a center hole 22 that is substantially the same diameter as the center hole 14 in the base portion 4. The top portion 18 and adjustable angle indicator arms 10, 12 reside on top of the base portion. A rivet-like collar portion 20 is used to attach the disk-shaped top portion 18 and adjustable indicator arms 10, 12 to the base portion 4 (described further below).

Figure 1B:
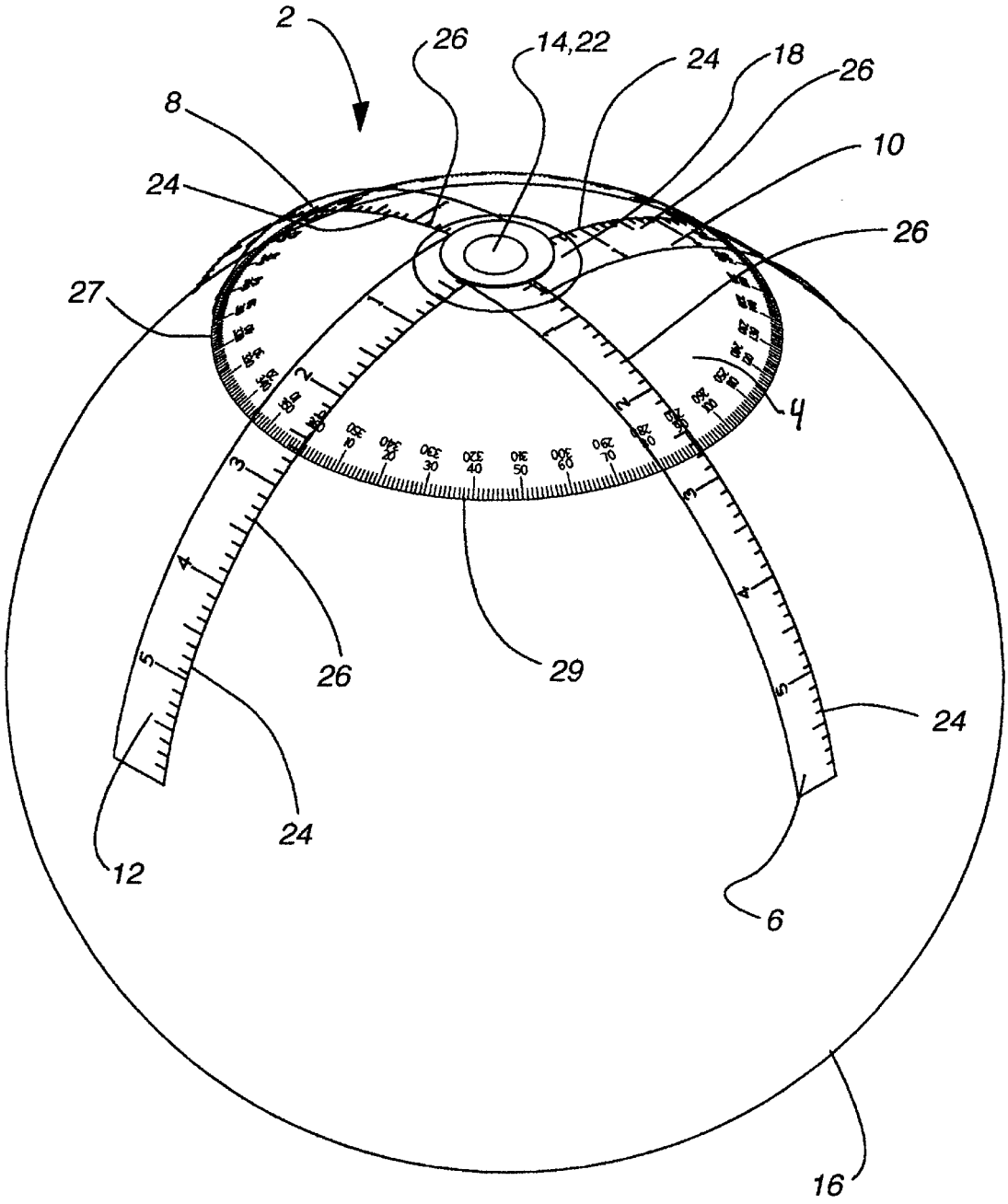
FIG. 1B is a front isometric view of one embodiment of the angulator device placed on a bowling ball.

As illustrated in FIG. 1B, the base portion 4, top portion 18, and indicator arms 6, 8, 10, 12 of the angulator device 2 are generally curved to match the curvature of the bowling ball 16. The curvature of the angulator device 2 allows the device 2 to be easily moved around the surface 17 of the bowling ball 16. In fact, it is important that the curvature of the angulator device 2 closely match the curvature of the bowling ball 16 to minimize measurement errors when using the device 2. The base portion 4 has a partially-spherical shape to match the portion of the bowling ball which the base portion contacts.

Figure 2:
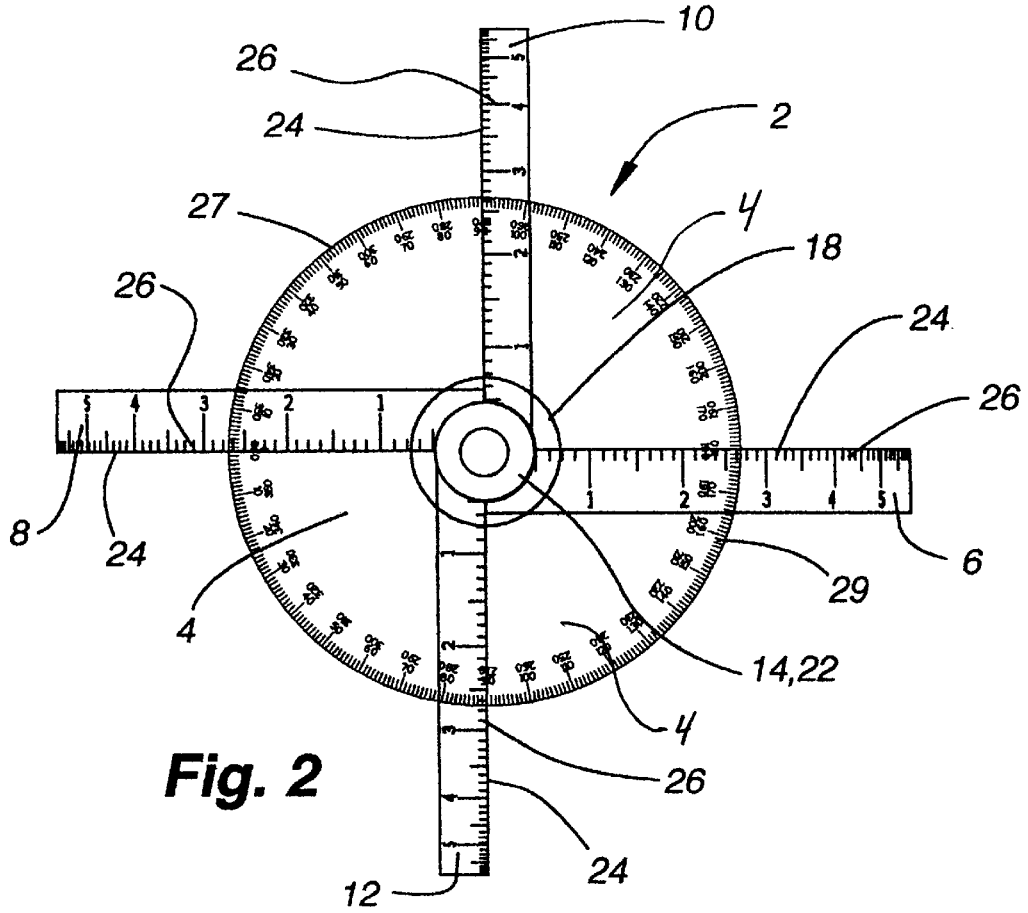
FIG. 2 is a top plan view of one embodiment of the angulator device.
Figure 3:
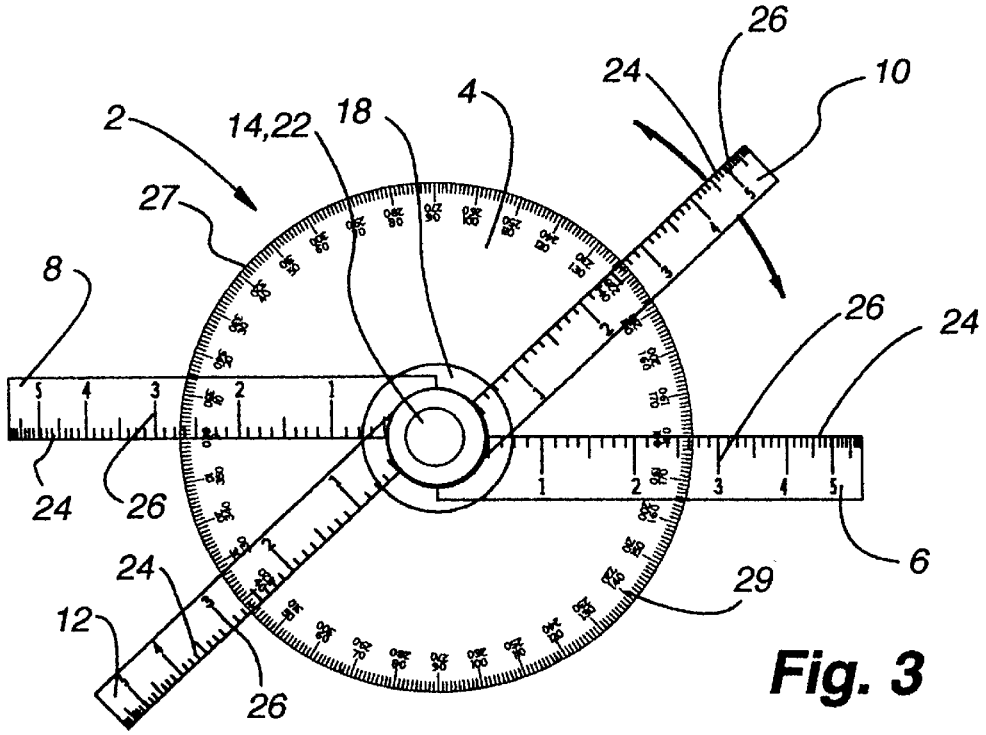
FIG. 3 is a top plan view of one embodiment of the angulator device with the adjustable indicator arm rotated.

FIGS. 2–3 illustrate the angulator device 2 not positioned on a bowling ball 16. As illustrated in FIG. 2, one edge 24 of each indicator arm 6, 8, 10, 12 extends through the center of the base portion aperture 14 of the device 2 (the trailing edge of each arm if the arms were moving clockwise), the center being the common point of rotation for the movable arms 10 and 12. In this manner, both the adjustable indicator arm and fixed indicator arm edges are off-set from one another, respectively. This configuration is required to ensure accurate angle measurements with the angulator device 2. In addition, the trailing edge 24 of each of the angle indicator arms includes length measurement indicators 26. In the embodiment illustrated in FIGS. 1–4, the length measurement indicators 26 are represented by English inch units. Other measurement units, such as metric units, may also be used.

Figure 4:
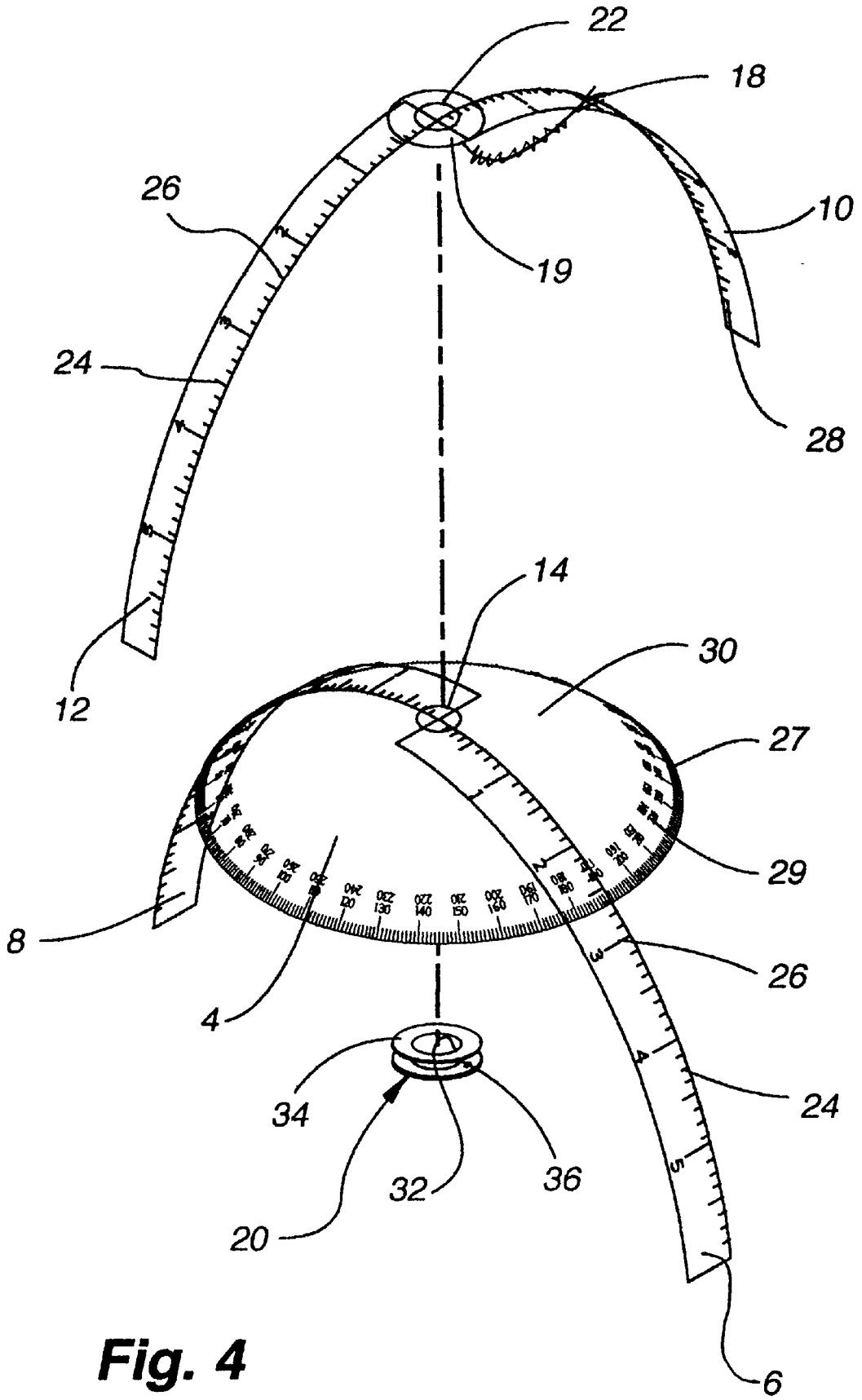
FIG. 4 is an exploded view of the embodiment illustrated in FIGS. 1–3.

As is illustrated in FIGS. 2–4, the perimeter 27 of the base portion 4 includes degree indicators 29 formed therein. In one embodiment, the degree indicators 29 begin at 0° and end at 360°. Also, the degree indicators 29 run in both directions. For example, 90° and 270° are at six o'clock in FIG. 2. At nine o'clock the numbers 0 and 360 are shown. At twelve o'clock the numbers 270 and 90 are shown, and at three o'clock the numbers 180 and 180 are shown. In a preferred embodiment, the 0, 360 degree and 180, 180 degree indicators are in alignment with edge 24 of fixed indicator arms 8, 6, respectively.

As mentioned earlier, and more clearly illustrated in FIG. 3, at least two of the angle indicator arms 10, 12 are adjustable. That is, angle indicator arms 10, 12 are configured to rotate about the center aperture 14 of the angulator device 2. The adjustability of two of the angle indicator arms 10, 12 allow for easy measurement of angles on the surface 17 of the bowling ball 16. The angle indicator arms 6, 8,10, 12, in addition to allowing a user to measure angles on the bowling ball surface 17, also provide a straight-edge surface for drawing lines on the bowling ball surface 17. In addition, they allow the user to precisely measure straight-line distances on the bowling ball surface 17.

In the embodiment illustrated in FIGS. 1–4, the top portion 18 of the device 2 is attached to two opposing indicator arms 10, 12 and a center disk-shaped portion 19. Indication arms 10 and 12 can be fabricated from one piece of material and therefore move in unison in the embodiment in FIGS. 1–4. The present invention also includes embodiments where multiple adjustable arms, moving independently of one another, are used in the device.

FIG. 4 illustrates an exploded view of one embodiment of the angulator device 2. The device 2 illustrated in FIGS. 1–4, is generally comprised of three pieces. The adjustable indicator arm piece 28 includes a central disk-shape portion 19 with two indicator arms 10, 12 extending therefrom and a center hole 22. The top portion 18 is rotatably positioned on top of the base portion 4.

The fixed indicator arm base portion 4 generally includes a central cap portion 30 with two indicator arms 6, 8 extending therefrom and a center 14 hole in the cap portion 30. The indicator arms are in fixed orientation relative to the base portion. The arms can extend from the perimeter of the base portion, or can lay along the top of the base portion and extend from the perimeter. What's important is that the edge 24 and the distance markings are visible where the arms overlap or extend along the base portion. A rivet-like collar 20 is used to attach the adjustable indicator arm top portion 18 with the fixed arm base portion 4. The collar 20 includes a central bore 32 and top 34 and bottom 36 head portions (FIG. 4). The center hole 22 of the adjustable arm top portion 18 and the center hole 14 of the fixed arm base portion 4 are axially-aligned with the central 32 of the collar 20. The top portion 18 and bottom portion 4 are held in alignment by the central bore portion 32 of the collar 30 which extends through the center holes 14, 22 of both the top 18 and bottom 4 portions. The top 18 and bottom 4 portions are secured to one another and retained in position by the top 34 and bottom 36 head portions of the collar 20.

Figure 5:
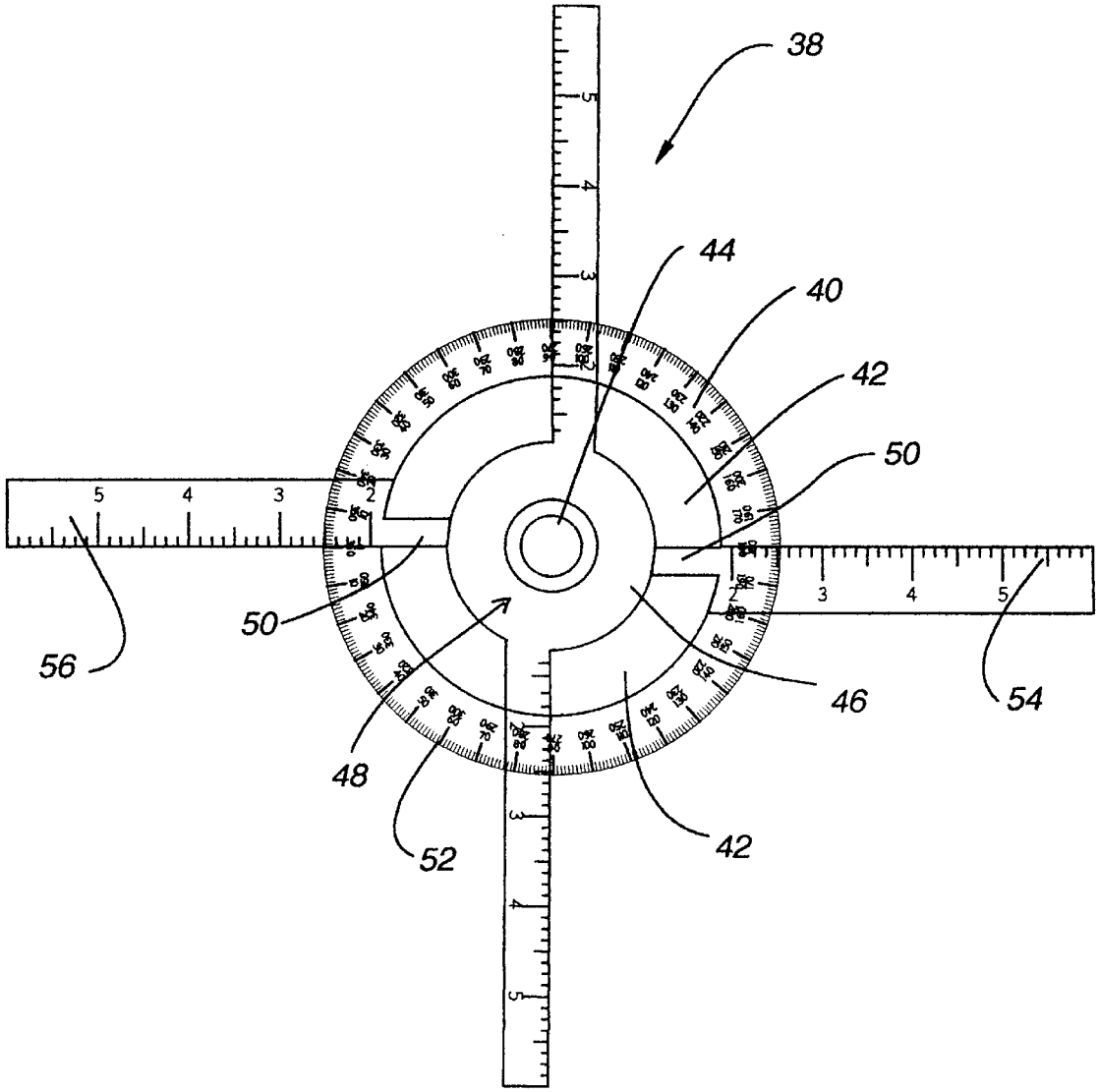
FIG. 5 is a top plan view of one embodiment of the angulator device.
Figure 7:
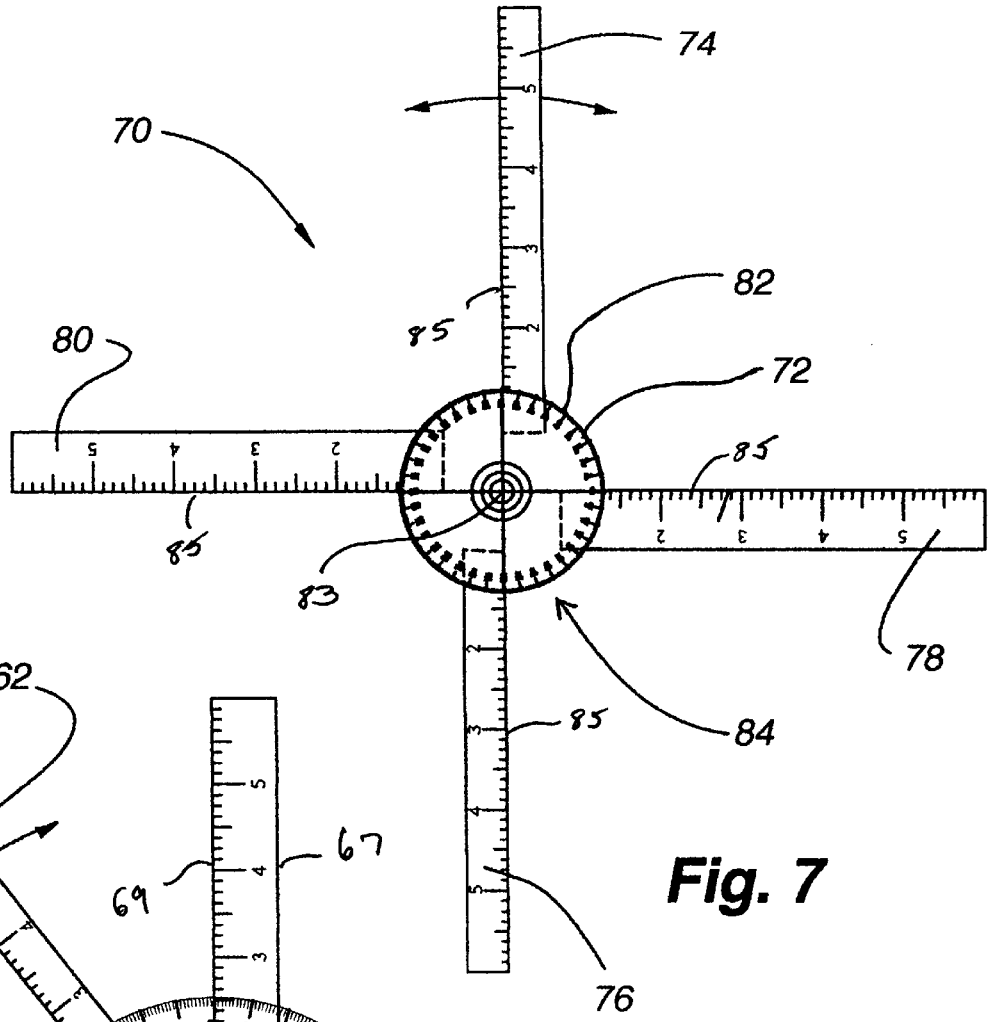
FIG. 7 is a top plan view of one embodiment of the angulator device.
Figure 6:
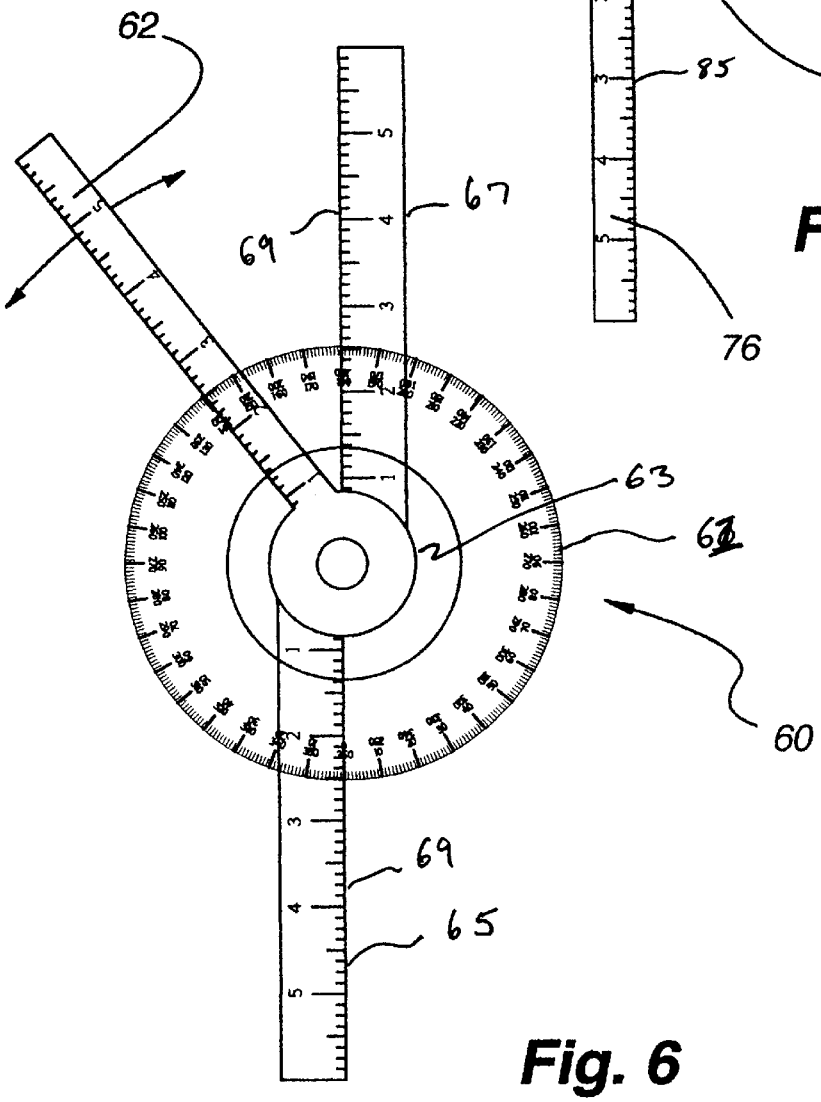
FIG. 6 is a top plan view of one embodiment of the angulator device.

FIGS. 5–7 illustrate alternative embodiments of the angulator device 2. In FIG. 5, the device 38 illustrated is substantially similar to the embodiment illustrated in FIGS. 1–4. However, the fixed indicator arm base portion 40 includes two open areas 42. In addition to the center hole 44 of the angulator device 38 in FIG. 5, the two open areas 42 of the base portion 40 also allow the user to contact the surface of the bowling ball 16 that lies beneath the angulator device 38. The open areas are defined by the rim of the base portion and the extension of fixed arms 54 and 56. In this embodiment, the open areas are semi-circular to maximize access to the surface of the bowling ball. The open areas can also have other shapes. Although it cannot be seen in FIG. 5, the base portion 40 includes a central cap portion. The cap portion in the embodiment illustrated in FIG. 5, is equal to or less than the size of the disk-shaped portion 46 of the adjustable indicator arm top portion 48. The adjustable indicator arm top portion 48 is rotatably attached with the cap portion of the base portion 40. Two support arms 50 extend from the cap portion out to the perimeter 52 of the base portion 40, and in this embodiment extend outwardly to form the fixed indicator arms 54, 56, which extend beyond the base portion 40.

The embodiment 60 illustrated in FIG. 6 is substantially similar to the prior embodiments described. However, the embodiment 60 in FIG. 6 only includes one adjustable angle indicator arm 62. Although while for ease of use it is preferred that two adjustable indicator arms are included with the device 60, it is possible to perform all of the angulator device 60 functions with only one adjustable angle indicator arm 62. In the embodiment shown in FIG. 6, the base portion 61 has a general shape of the previously described base portions, that being partially spherical in shape in order to closely fit on the outer surface of a bowling ball. The base portion 61 defines a central substantially annular opening surrounding a center portion 63. The fixed arms 65 and 67 extend diametrically away from the central portion, with each defining an edge which aligns with the 0 and 180 degree marks formed on the outer rim of the base portion, respectively. The fixed arms connect the central portion 63 to the base portion. Each of the arms extends substantially radially, at least along the alignment edge from the central portion and the base portion. The arms extend approximately 6 inches in either direction from the central portion. Each of the arms is marked with a scale, shown in inches, along the alignment edge of each arm.

The central portion defines an aperture, as is similar with the central portions defined above, for a rotational connection with the moveable arm extension 62. This moveable arm extension 62, or indicator arm, is rotationally attached to the central portion by a collar position through the aperture, as is similar with that described above in order to allow the arm 62 to rotate relative to the base portion and to the other arm extensions. The adjustable arm also has a scale marked in inches along the alignment edge. One of the edges on the adjustable arm forms an alignment edge since it is in alignment with the degree markings around the perimeter of the base portion 61. The base portion is preferably clear and able to be seen through, and an annular space allows the user to contact the bowling ball surface if desired. The arrows associated with arm 62 in FIG. 6 show that the arm can move in either direction relative to the base portion.

Generally, the more arms included on the device and the more accurate the measurements performed with the device will be. An example of this is the use of the device to locate a bowler's PAP, which is described in greater detail below. A device with more arms will allow the user to more accurately locate the bowler's PAP. As a result, any other measurements that rely on locating the PAP will also be impacted. In a preferred embodiment, the device will include four arms total. However, a device could be developed that has less than four indicator arms or greater than four indicator arms.

The device 70 illustrated in FIG. 7 is substantially similar to the embodiment 2 illustrated in FIGS. 1–4. However, the base portion 72 of the device 70 in FIG. 7 includes a smaller cap-like portion, which diameter is the same size as the diameter of the disk-shaped cap portion 82 of the adjustable indicator arm top portion 84. The base portion 72 is rotatably connected to its center 83 to the disk-shaped portion 82. The arms 74 and 76 are attached to the base portion 72 in a fixed relationship thereto. The arms 78 and 80 can thus move relative to the fixed arms about the center 83. As with the above embodiment, the alignment edges 85 all form lines that intersect at the center 83 for accurate ball lay out. The angle measurement indicators 78 and 80, and 80 are included on the disk-shaped portion 82 of the top portion 84. The embodiment 70 illustrated in FIG. 7 could also be fabricated with only one adjustable indicator arm.

In all of the embodiments described and illustrated above, plastic is the preferred material of construction. In a preferred embodiment, the material used is transparent or semi-transparent. Transparent or semi-transparent materials allow the user to more easily and accurately manipulate the device on the surface of the bowling ball because the pertinent marks on the surface of the bowling ball are apparent. While transparent or semi-transparent materials are preferred, the device could also be manufactured using non-transparent materials such as plastic or steel.

As mentioned above, the bowling ball angulator device can be used for diagnostic purposes on drilled bowling balls, for laying out the gripping hole locations on undrilled bowling balls, or for transferring the layout from one ball to another. FIGS. 8–11 illustrate a diagnostic method of using the angulator device. FIGS. 8–11 illustrate the present inventive method of measuring the thumb hole angle on a drilled bowling ball using any of the layout devices described above. The methods described herein are explained using a left-handed bowler as an example. Obviously, these methods can be used for a right-handed bowler by doing the mirror image of the directions described in each method. The device described above is fabricated to be used on bowling balls used by both left-handed and right-handed bowlers.

The thumb angle 86 of a bowling ball 16 thumb hole 88 is the angle that the thumb hole 88 is rotated from the centerline 90 of the bowling ball grip. The cross-sectional shape of a thumb 92 is substantially oval. As a result, the shape of the thumb hole 88 or thumb hole insert is generally oval. When holding a bowling ball 16, the center-line 94 of the oval-shaped thumb hole 88 is rotated with respect to the centerline 90 of the bowling ball 16 grip. For users that particularly prefer to have an oval-shaped thumb hole 88, the thumb hole rotation angle 86 is important.

Figure 8:
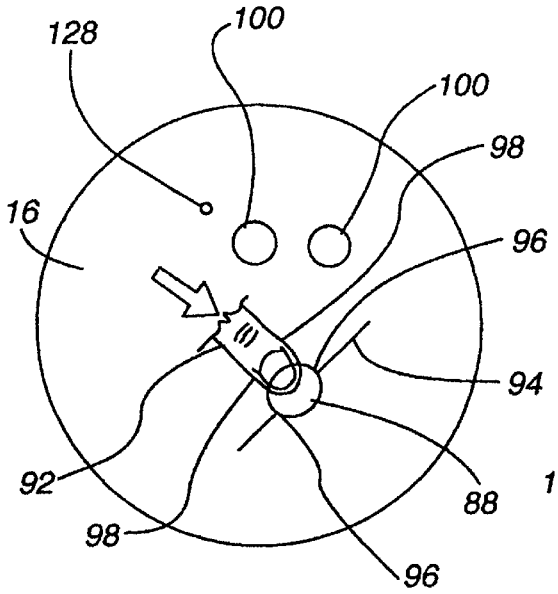
FIGS. 8–11 illustrates a method for measuring the thumb angle of a drilled bowling ball.
Figure 9:
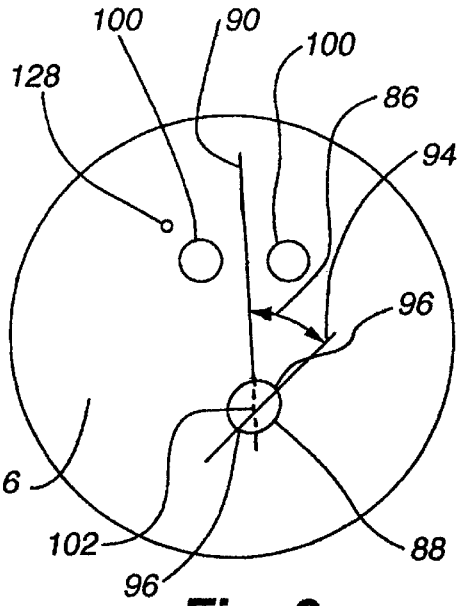

As illustrated in FIG. 8, the first step in measuring the thumb hole angle 86 of a drilled bowling ball 16 is to place the ball user's thumb 92 in the thumb bole 88. In FIG. 8 a left-handed bowler's thumb 92 is illustrated. After the bowler places their thumb 92 in the thumb hole 88, the edges 96 of the thumb hole adjacent where the sides 98 of the bowler's thumb 92 are located within or contact the periphery of the thumb hole 88 are marked. Next, one of the indicator arms on the angulator device 2 is used as a straight edge to draw a line 94 on the bowling ball surface through the marks on the thumb hole 88. The line 94 is extended toward the finger holes 100 on the bowling ball 16. One of the angle indicator arms is next used to draw the centerline 90 of the bowling ball 16 grip. As illustrated in FIG. 9, the centerline 90 of the bowling ball 16 grip runs through the mid-point of the finger holes 100 and through the center 102 of the thumb hole 88. The angle 86 between the two lines 94, 90 illustrated in FIG. 9 represents the thumb hole angle 86 of the bowling ball 16.

Figure 10:
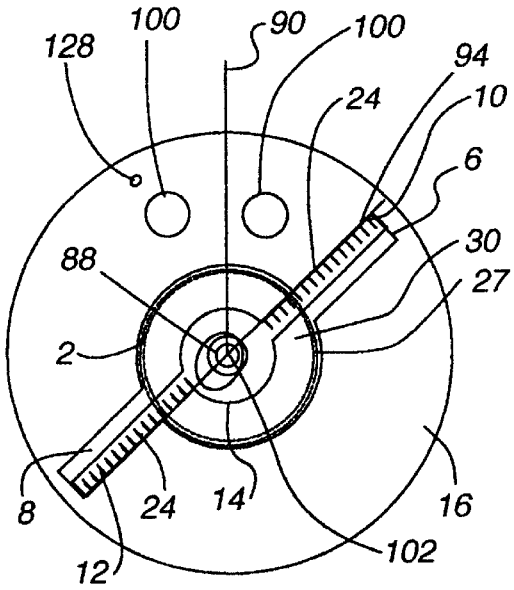
Figure 11:
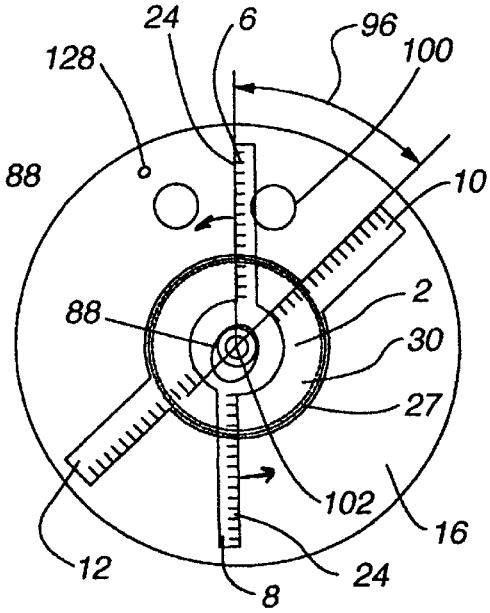

To measure the thumb hole angle 86 of the bowling ball 16, the user next centers the center hole 14 of the angulator device 2 over the center 102 of the thumb hole 88. The user lines-up the adjustable indicator arms 10, 12 so they reside on top of the fixed indicator arms 6, 8 as illustrated in FIG. 10 (all center or trailing edges 24 are in alignment) and such that they are in alignment with the center-line 94 of the thumb hole 88. The user next rotates the adjustable angle indicator arms 10, 12 until the leading edge 24 (rotating in a counter-clockwise manner) reaches the centerline 90 of the bowling ball 16 grip. The user then reads the angle 86 indicated by the leading edge 24 on the perimeter 27 of the cap portion 30 of the angulator device 2 to determine the thumb angle 86 of the bowling ball 16.

For a right-handed bowler, the user would begin with the center-line edge 24 of both sets of indicator arms 6, 8, 10, 12 aligned with the centerline 90 of the bowling ball 16 grip. Next, the user would rotate the adjustable indicator arms 10, 12 until the trailing edge 24 (rotating in a clock-wise direction) came into alignment with the center-line 94 of the grip thumb hole 88. Finally, the user would read the angle 86 indicated by the leading edge 24 on the perimeter 27 of the cap portion 30 of the angulator device 2 to determine the thumb hole angle 86 for a right-handed bowler.

A preferred method for measuring the thumb hole angle of a bowling ball is described herein. Obviously, there are other ways to measure the angle between lines 90 and 94 (e.g., first lining the fixed indicator arms 10, 12 with the center-line 94 of the thumb hole and then measuring the angle to the centerline 90 of the ball, etc.). The present invention contemplates these and other methods of measuring the angle between lines 90 and 94 using the inventive device. Traditionally, the angle measured is the acute angle. However, the angle measured could also be relayed using the angle greater than 90 degrees (360 degrees minus the acute angle).

Figure 12:
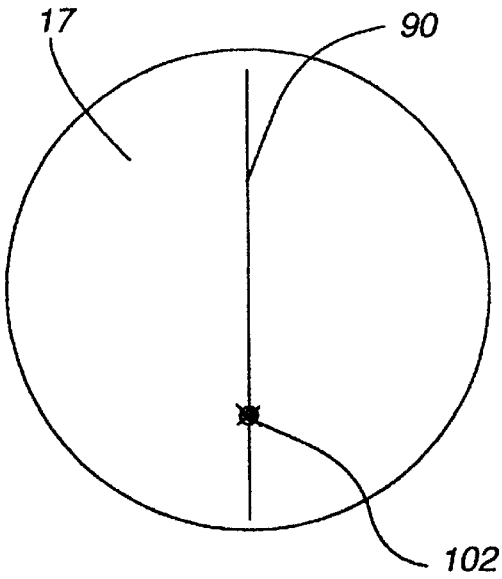
FIGS. 12–14 illustrates a method for measuring the thumb angle of an undrilled bowling ball.
Figure 14:
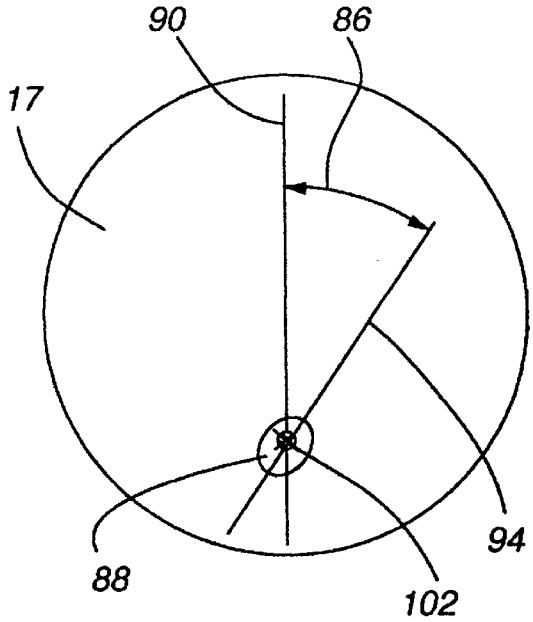
Figure 13:
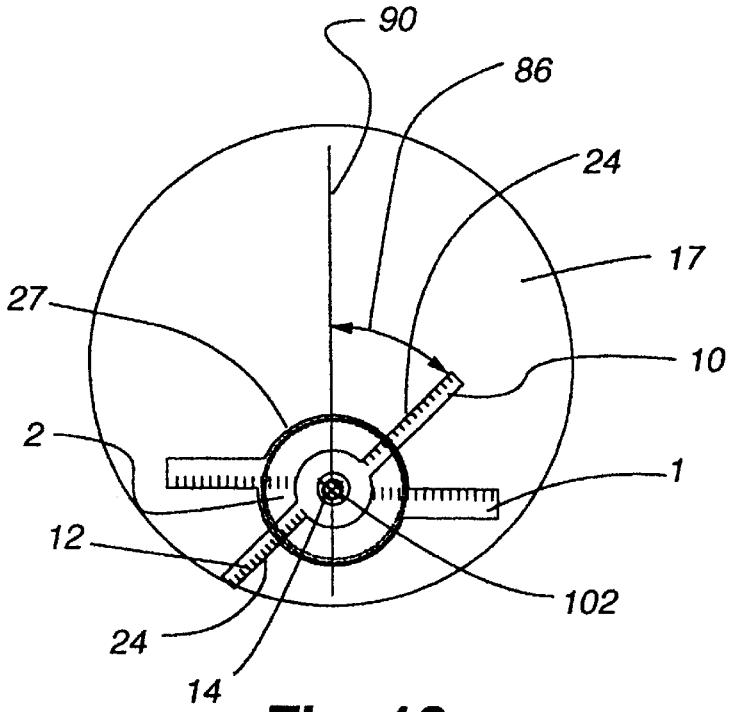

The angulator device 2 can also be used to lay out the thumb hole angle 86 on an undrilled bowling ball 17. FIGS. 12–14 illustrate a method for locating the thumb hole angle 86 on an undrilled bowling ball 17. Prior to using the angulator device 2 to lay out the thumb hole angle 86 on an undrilled bowling ball 17, the user must locate and mark on the bowling ball 17 the bowling ball grip centerline 90 and thumb hole 88 center 102 using methods described below. Next, the angulator device 2 center hole 14 is placed over the thumb hole center marking 102 on the bowling ball 17. Preferably, the device 2 is rotated so that the grip centerline 90 runs through the 0° and 180° markings on the perimeter 27 of the cap portion 30 of the angulator 2 with the 0° fixed indicator arm 8 pointing to the finger holes. Next, the adjustable angle indicator arm 10 is rotated from the grip centerline 90 until it reaches the given thumb hole angle 86 (in a clock-wise motion for a left-hand bowler or counter-clock-wise for a right-hand bowler). A line 94 is drawn along the adjustable indicator edge 24 to mark the center-line 94 of the thumb hole 88. As illustrated in FIG. 14, one of the arm indicators 6, 8, 10, 12 is used to extend the line 94 through the thumb hole center marking 102 to more clearly illustrate the thumb hole angle 86 on the bowling ball 17 surface. As mentioned above, lines 90 and 94 and the angle between can be placed on the surface of the bowling ball in any order (i.e., either line can be drawn first and the other line subsequently located by rotating a distance equal to the thumb hole angle).

As discussed above, the rolling dynamics of a bowling ball are significantly affected by the placement of the bowler's grip on the bowling ball with respect to the location of the weight block inside the bowling ball relative to a respective bowler's track. In the prior art, no effective way to properly measure the location of a bowler's grip on the bowling ball with respect to the location of the weight block within the bowling ball relative to a respective bowler's track is believed to have been disclosed. FIGS. 15–22 illustrate various diagnostic methods using the present invention bowling ball angulator device to accurately determine the location of the bowling ball finger holes and the thumb hole (if included in grip) with respect to the bowling ball's internal weight block and the bowler's track. These methods allow a user to configure multiple bowling balls with substantially similar rolling dynamics. It also allows a user to substantially alter the rolling dynamics of a particular bowling ball through orienting the weight block to the bowler's track.

Figure 15:
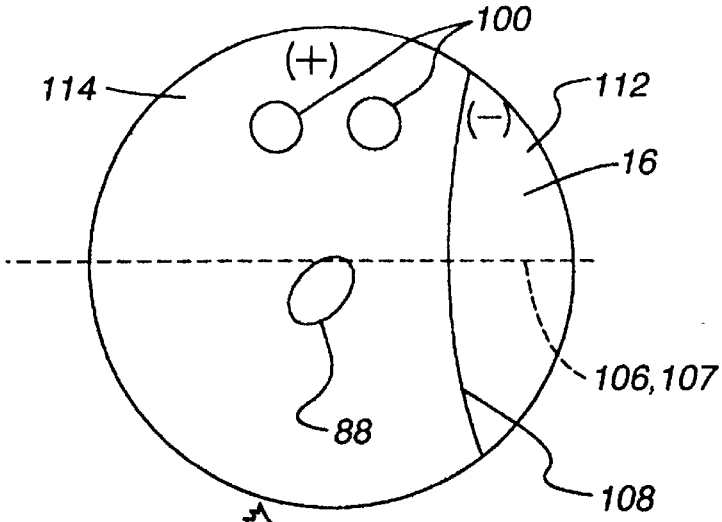
FIGS. 15–17 illustrates a method for locating the positive axis point (PAP) of a drilled bowling ball using the angulator device.
Figure 16:
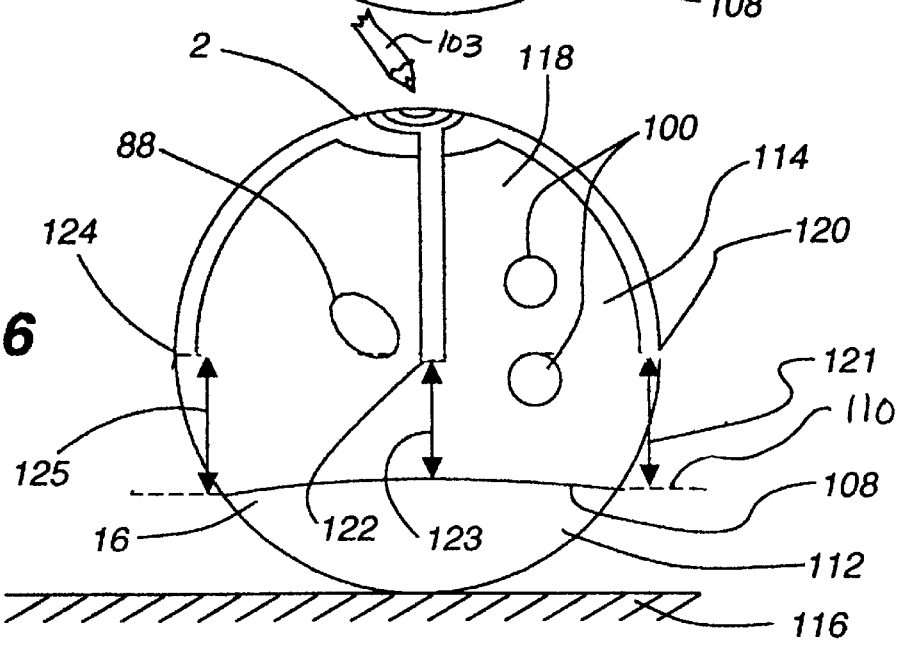
Figure 17:
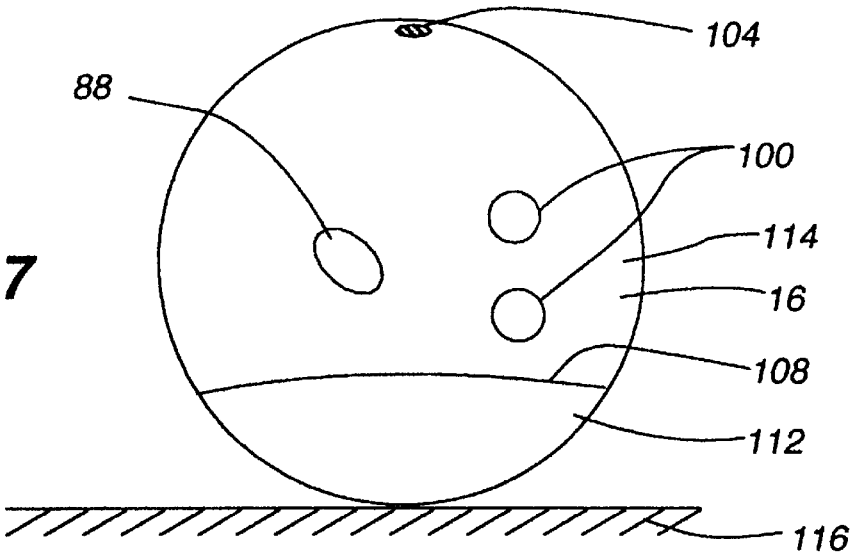

FIGS. 15–17 illustrate a diagnostic method for locating a positive axis point 104 (see FIG. 18) on a drilled bowling ball 16. As the bowling ball moves down the lane, it essentially spins on the conditioned or oiled lane surface. It spins in a direction not associated with a "rolling" action, but about a different axis. As the ball 16 moves down the lane, it is rotating or spinning around an imaginary axis 106 through the center 107 of the bowling ball 16. Because of the rolling dynamics related to the weight balance of the bowling ball 16 and the manner in which the ball 16 is thrown, a bowling ball 16 typically spins or rolls on a track 108 found on the outer surface of the bowling ball. The track 107 is continuous around the outer surface and defines a plane 110 that cuts through an outer portion 112 of the bowling ball 16 rather than through the center 107 of the bowling ball 16. As illustrated in FIG. 15, the smaller portion 112 of the bowling ball 16 defined by the track 108 is typically called the negative portion 112 of the bowling ball 16. The larger portion 114 of the bowling ball 16 defined by the track 108 is typically called the positive portion 114 of the bowling ball 16. The center of the positive portion 114 of the bowling ball 16 is known as the positive axis point (PAP) 104.

To determine the positive axis point 104 of a drilled bowling ball 16, one must first mark the track 108 on the outer surface of the bowling ball 16. To mark the track 108, the user releases the bowling ball 16 down the lane (or in some other manner, such as on a rug or other surface) in a normal releasing manner to identify the location of the respective bowler's track. The oil or conditioner from the lane, or dust from a carpet, is often readily visible on the surface of the bowling ball 16 in the location of the track 108 (and actually marks the track) after rolling the ball down the lane or on a carpet. By retrieving the bowling ball 16 soon after it has been released down the lane, one can use a crayon-type or oil based pencil or marker to trace the track 108 on the surface of the bowling ball 16. After marking the track 108 on the bowling ball 16, the user next places the bowling ball 16 on a flat surface 116 such that the negative portion 112 of the bowling ball 16 is resting on the surface 116 and the plane 110 defined by the bowling ball track 108 is parallel to the flat surface 116 as illustrated in FIG. 16.

The user next places the angulator device 2 on top 118 of the positive side 114 of the bowling ball 16 with the four angle indicator arms 6, 8, 10, 12 spaced 90° apart and dividing the bowling ball into four quadrants (as viewed from the top). The user aligns the device 2 such that the four angle indicator arm ends 120, 122, 124, and fourth arm (only three arms visible in FIG. 16) are at an equal distance from the bowling ball track 108. As illustrated in FIG. 16, distances 121, 123, and 125 represent the distances from each of three indicator arm ends 120, 122, 124, respectively, visible to the bowling ball track 108. When distances 121, 123, 125, and the respective distance from the fourth arm (not visible) end to the track 108 are equal, the center hole 14 of the angulator device 2 is aligned over top of the positive axis point 104. The hole 14 in the base portion of the angulator device 2 allows the user to use a crayon-type pencil 103 or other means to mark the positive axis point 104 on the surface of the bowling ball 16 (see FIG. 17). The use of the words equal or identical all refer to accuracy and are not meant to be a limiting feature of the present invention. For instance, if the arms are not equidistant from the track in FIG. 16, then the PAP 104 will be slightly misplaced in the marking step as shown in FIGS. 16 and 17. It is contemplated that even a slightly misplaced PAP is still a valuable data point for laying out a bowling ball. Also, the use of all four arms is not required. Two arms equidistant from the track would suffice to accurately locate the PAP 104. Further, by accurately positioning the ball on the support surface after identifying the track, one could find the PAP by locating the point on the top of the ball diametrically opposed from the point of contact with the surface 116, which would also locate the PAP 104. The device of the present invention, and its benefits as a measuring and scaling tool make act of locating the PAP 104 much more simple, accurate, and repeatable.

An important diagnostic measurement of a bowling ball 16 is distance from the bowling ball's pin 128 (FIG. 18) to the bowling ball's positive axis point 104. The pin 128 of a bowling ball 16 is an indicator of the position of the weight block 130 in a bowling ball 16. The bowling ball pin 128 is usually marked by a small colored circle 128 on the surface of the bowling ball 16. To measure the pin distance 126 of a bowling ball 16 to the PAP 104, one arm 10 of the angulator device 2 is lined up from the pin 128 to the PAP 104 and reads the length measurement indicated on the arm 10 (see FIG. 18).

Figure 20:
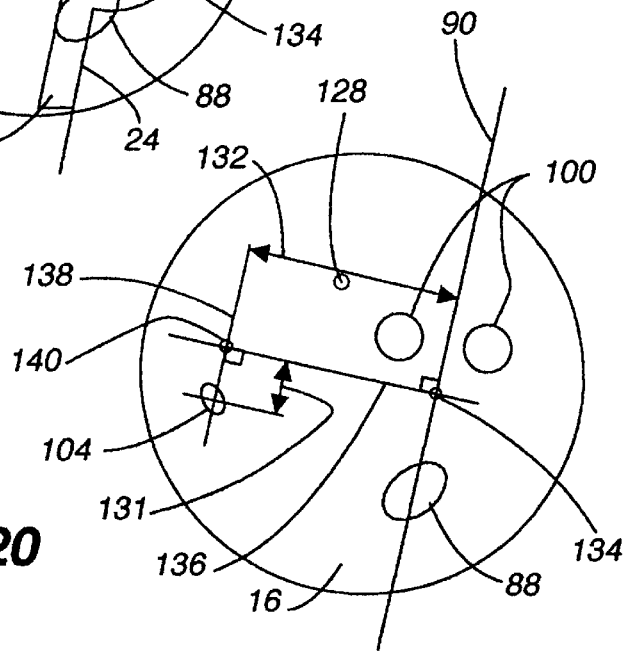

Referring to FIG. 20, the positive axis point 104 for a drilled bowling ball 16 is always located a vertical distance 131 and a horizontal distance 132 away from the grip center 134 (in some cases the PAP 104 may have a vertical 131 of zero). These measurements are known as the positive axis point 104 vertical coordinate 131 and positive axis point horizontal coordinate 132.

Figure 19:
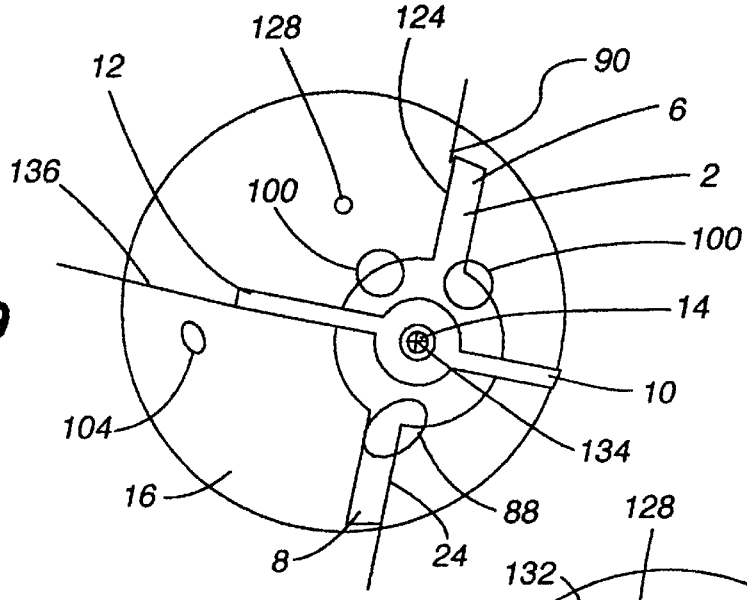
FIGS. 19–20 illustrates the method for measuring the PAP vertical coordinate and PAP horizontal coordinate of a drilled bowling ball relative to the grip center (GC) of the bowler's grip along the grip centerline (CL) and relative to the midline (ML).

FIGS. 19–20 illustrate a method for measuring a drilled bowling ball's PAP vertical coordinate 131. To measure the PAP vertical coordinate 131 of the bowling ball 16, the user first locates and marks the PAP 104, the grip center 134, and the centerline 90 of the grip on the bowling ball 16 surface. The user next places the center hole 14 of the angulator device 2 over the grip center marking 134 with the measurement indicator edges 24 of both fixed indicator arms 6, 8 in alignment with the centerline 90 of the grip. The user next rotates the adjustable indicator arms 10, 12 such that they are 90° from the fixed indicator arms 6, 8. The user draws a line 136 along the adjustable indicator arms 10, 12 that is perpendicular to the grip centerline 90 and extends the line 136 toward and past the positive axis point 104 (midline (ML)).

Next, the user draws a line 138 extending from the positive axis point 104 perpendicular to and through the midline 136 (PAP-I-point line 138). The user uses the angulator device 2 to properly layout the line 138 extending at a right angle from the positive axis point 104. By aligning one set of the indicator arms (fixed or adjustable) with the midline 136 and off-setting the other set of indicator arms 90° away, the user can mark a line 138 on the ball that extends through the positive axis point and is perpendicular to the midline 136. Any one of the indicator arms can be used to extend the line 138 at a right angle through the positive axis point 104 and through the midline 136. The intersection 140 of the PAP-I-point line 138 and the midline 136 is then marked by the user. This intersection 140 is known as the PAP coordinates intersection point or the I-point 140. To measure the PAP vertical coordinate 131, any one of the indicator arms 6, 8, 10, 12 is used to measure the distance from the PAP 104 to the I-point 140 along line 138. The measured distance is the PAP vertical coordinate 131.

The present invention also includes a method for measuring the PAP horizontal coordinate 132. As illustrated in FIG. 20, the PAP horizontal coordinate 132 is the distance from the I-point 140 to the center 134 of the grip measured along the midline 136. The method for measuring the PAP horizontal coordinate 132 is substantially similar to the method for measuring the PAP vertical coordinate 131. However, after locating the I-point 140, any one of the indicator arms 6, 8, 10, 12 is used to measure the PAP horizontal coordinate 132 along line 136.

Figure 21:
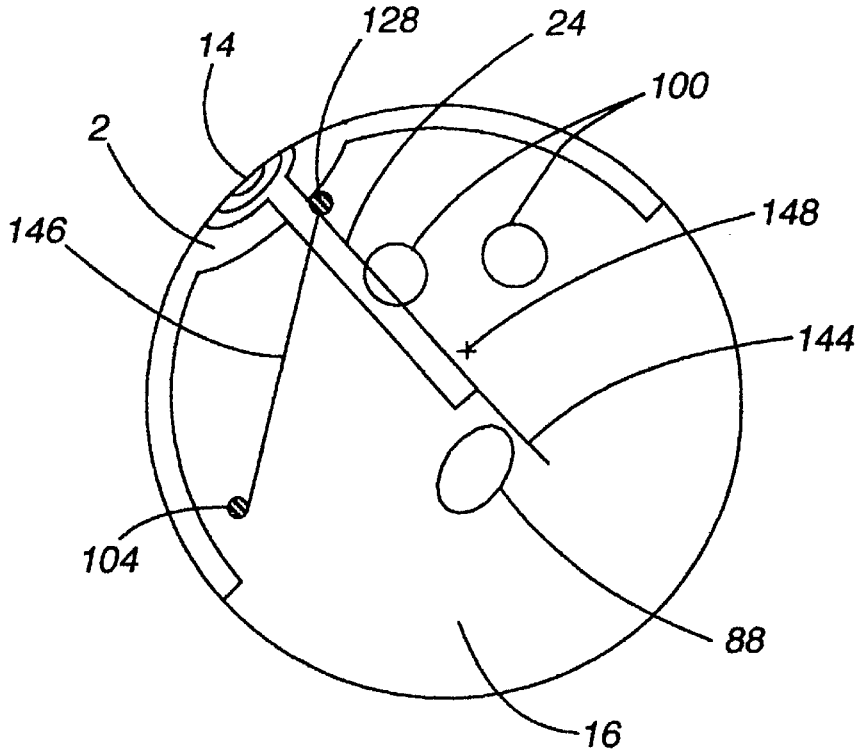
FIGS. 21–22 illustrates a method of measuring the block angle of the drilled bowling ball.
Figure 22:
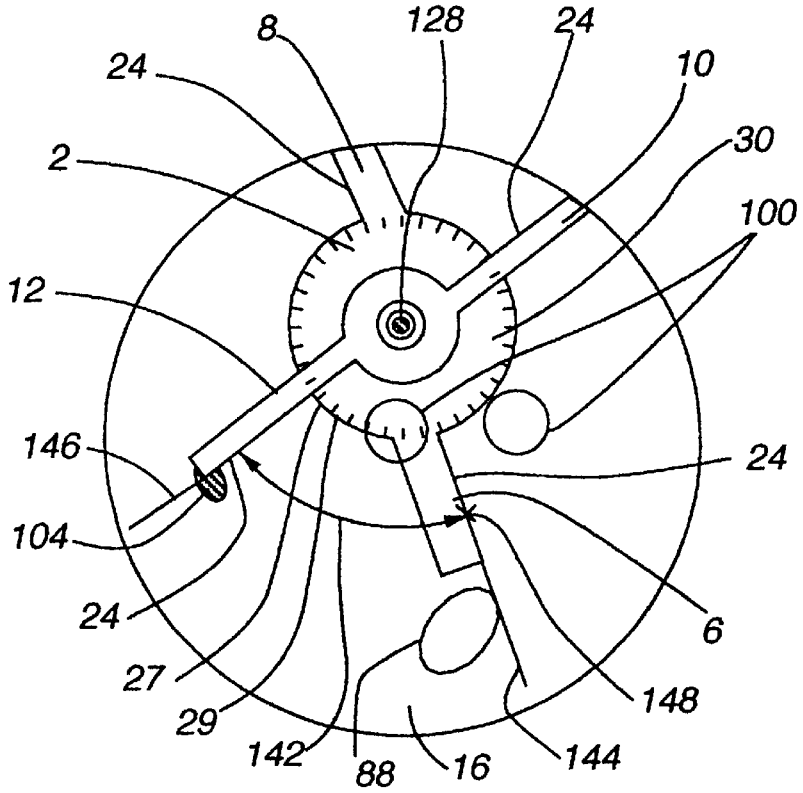

FIGS. 21–22 illustrate a method of measuring the weight block angle 142 of a drilled bowling ball 16. The block angle 142 is the angle between the line extending from the bowling ball pin 128 to the bowling ball center of gravity (CG) 148 (pin-CG line 144), or mass bias if one is present, and the line extending from the bowling ball pin 128 to the bowling ball PAP (pin-PAP line 146). Both the pin 128 and the center of gravity 148 (and mass bias if one is present ) are typically marked on the bowling ball 16 by the bowling ball manufacturer. In addition, a method has been described herein for locating the PAP 104 of a drilled bowling ball 16. In FIG. 21, the CG 148 is shown near the center of grip, but this is merely coincidence.

To measure the weight block angle 142 of a drilled bowling ball 16, the user first draws lines from the pin 128 to the center of gravity 148 (pin-CG line 144), or mass bias if one is present, and from the pin to the PAP (pin-PAP line 146) using any one of the angulator indicator arms 6, 8, 10, 12 as a straight edge. Next, the user places the center hole 14 of the angulator device 2 over the pin 128. The user aligns the length indicator edge 24 of one of the fixed indicator arms 6, 8 with either the pin-CG line 144 (or pin-mass bias line if a mass bias is present) or the pin-PAP line 146. The user then rotates the adjustable indicator arms 10, 12 to the other line (either the pin-CG line 144 or the pin-PAP line 146, whichever the fixed indicator arms 10, 12 are not aligned with). The user aligns the length indicator edge 24 of the adjustable indicator arms 10, 12 with the line selected. The user then measures the block angle 142 between the-pin-CG line 144 and pin-PAP line 146 by reading the angle off of the angle indicators 29 on the perimeter 27 of the cap portion 30 of the angulator device 2.

After determining the PAP 104, the pin distance 126 from the PAP 104, the PAP vertical coordinate 131, the PAP horizontal coordinate 132, the I-point 140, and the block angle 142 all of which are located and/or measured as described herein, a user can lay out an undrilled ball 17 with substantially similar rolling dynamics to that of a previously measured drilled bowling ball 16 having a desired weight block angle 142 relative to the bowler's track using the angulator device 2.

FIGS. 23–29 illustrate methods for laying out the gripping holes on an undrilled bowling ball 17 in accordance with given measurements such as the PAP 104, the desired pin distance 126 from the PAP 104, the PAP horizontal coordinate 132, the PAP vertical coordinate 131, the PAP I-point 140, and the weight block angle 142.

Figure 23:
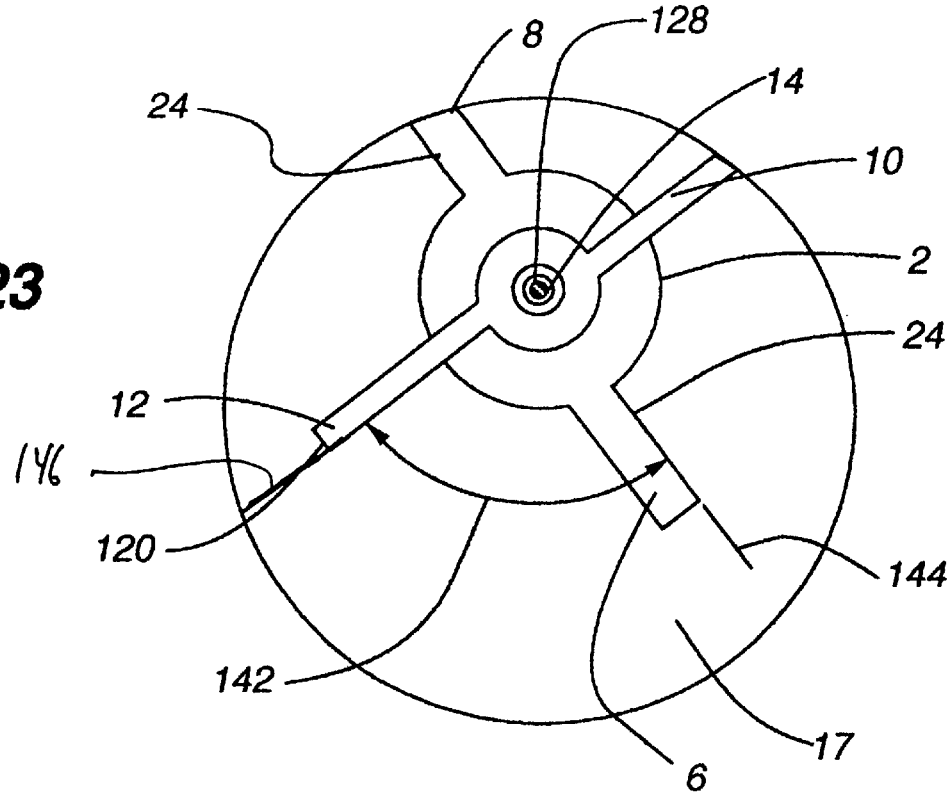
FIGS. 23–24 illustrates a method for locating the PAP on an undrilled bowling ball.
Figure 24:
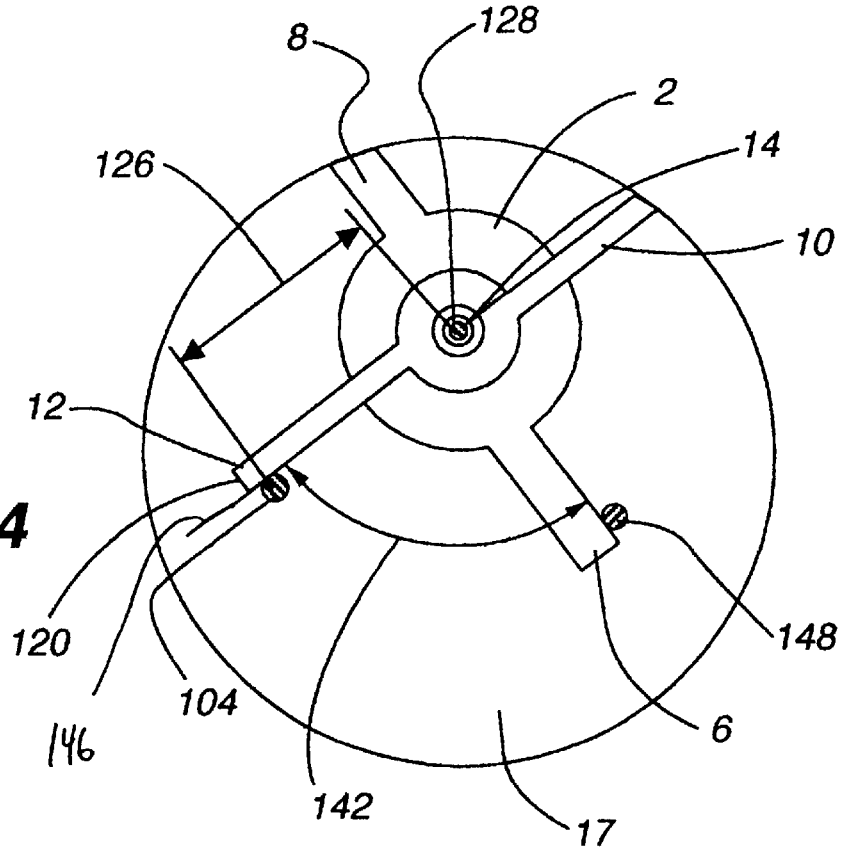

FIGS. 23–24 illustrate a method for placing the positive axis point 104 on an undrilled bowling ball 17 in accordance with a given weight block angle 142 and a given pin distance 126. As illustrated in FIG. 23, the user places the angulator device center hole 14 over the bowling ball pin 128 with the length measurement side 24 of the fixed indicator arms 6, 8 in alignment with the pin-CG line 144. Next, the user rotates the adjustable indicator arms 10, 12 about the center 14 of the angulator device 2 until the edge 24 of the adjustable indicator arm 12 is rotated to the desired weight block angle 142. Referring to FIG. 24, the user then draws a line along the edge 24 of the adjustable indicator arm 12 to create the pin-PAP line 146. The user then measures a distance equal to the desired pin distance 126 from the pin 128 toward the end 120 of the adjustable indicator arm 12 along the pin-PAP line 146. The user marks the bowling ball 17 surface at the desired pin distance 126 along the pin-PAP line 146 with the indicator arms 6, 12 spaced apart at an angle equal to the weight block angle. The mark represents the location of the positive axis point (PAP) 104 in accordance with the given block angle 142 and given pin distance 126 (see FIG. 24). If the pin distance 126 extends past the end of the arm, a supplemental measuring device, such as a pliable ruler could be used to align with the arm 12 (in FIG. 24).

Figure 25:
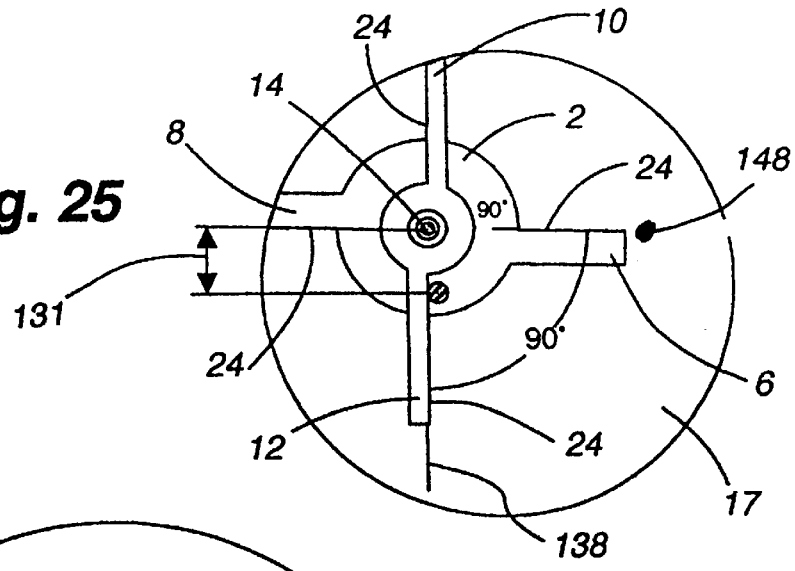
FIGS. 25–27 illustrates a method for locating the PAP I-point on an undrilled bowling ball using the angulator device.
Figure 26:
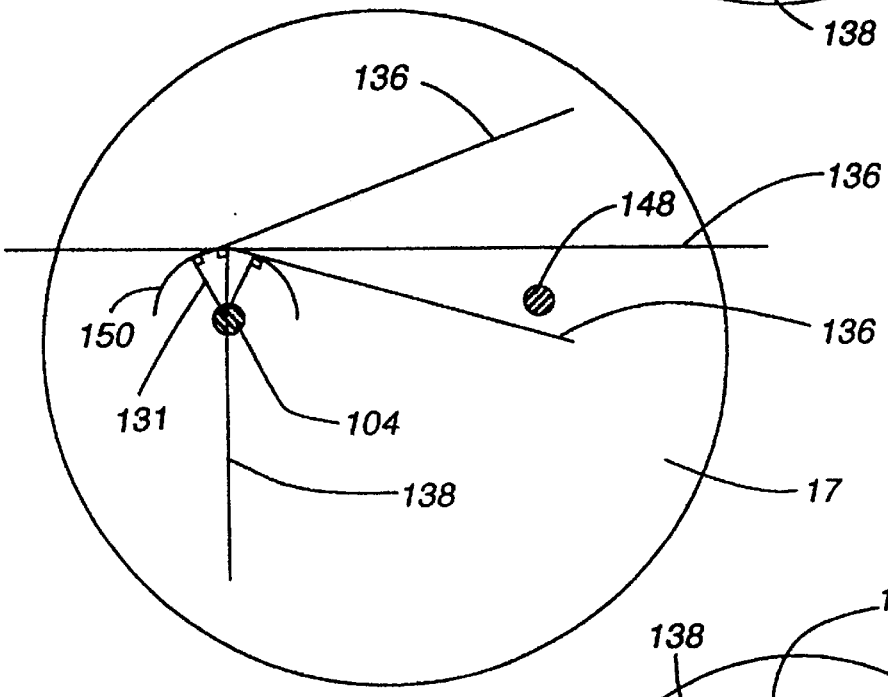
Figure 27:
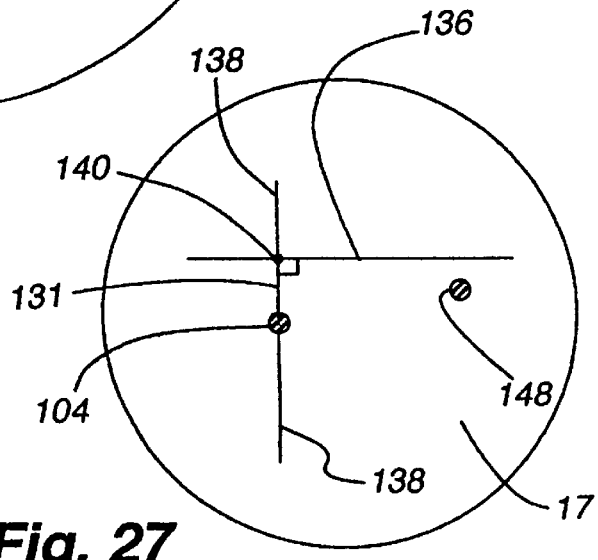

FIGS. 25–27 illustrate a method for placing the PAP coordinate intersection point (I-point) 140 on the surface of an undrilled bowling ball 17 assuming the PAP 104 and the center of gravity 148 are marked on the surface of the bowling ball 17 and the PAP vertical coordinate 131 is known (the PAP 104 is located using methods described herein). First, the user sets the angulator device indicator arms 6, 8, 10, 12 at 90° from one another.

Next, the user places the length indicator edge 24 of one of the indicator arms 10 next to the desired positive axis point 104 location at a distance equal to the PAP vertical coordinate 131 from the center hole 14 of the angulator device 2. If the given PAP vertical coordinate 131 is a positive number, the PAP 104 will reside above the center hole 14 of the angulator device 2. If the PAP vertical coordinate 131 is a negative number (as illustrated in FIG. 25), the PAP 104 will reside below the center hole 14 of the angulator device 2. The user next rotates the angulator device 2 around the positive axis point 104 until the length indicator edge 24 of one of the fixed indicator arms 6 comes into the desired alignment with the center of gravity 148 of the bowling ball 17. The entire time the angulator device 2 is being rotated, the adjustable indicator arms 10, 12 and fixed indicator arms 6, 8 are offset 90° from one another. Referring to FIG. 26, the center hole 14 of the angulator device 2 defines an arc 150 spaced a distance equal to the positive axis point vertical coordinate 131 around the PAP 104 as the angulator device 2 is rotated around the PAP 104. After the length indicator edge 24 of one of the indicator arms 6 reaches the desired location relative to the center of gravity 148, the user draws a line along the measurement indicator edge 24 of the indicator arm 6 and toward the PAP 104 (midline 136). This is the horizontal component of the PAP 104 and the horizontal coordinate 132 (FIG. 8) is measured along this line 148.

The angulator indicator arm 10 that is 90° from the indicator arm 6 along the midline 136 can also be used to draw a line perpendicular to the midline 136 (PAP-I-point line 138). Again, one of the device indicator arms can be used to extend the PAP-I-point line 138 through the PAP 104 and through the midline 136. The user should mark the intersection of the PAP-I-point line 138 with the midline 136. This mark represents the PAP coordinate intersection point or the I-point 140. Note in FIG. 26 that the I-point 140 can be located at many points along the arc 150 defined by the center hole 14 of the angulator device 2 as the device 2 is rotated around the PAP 104.

Figure 28:
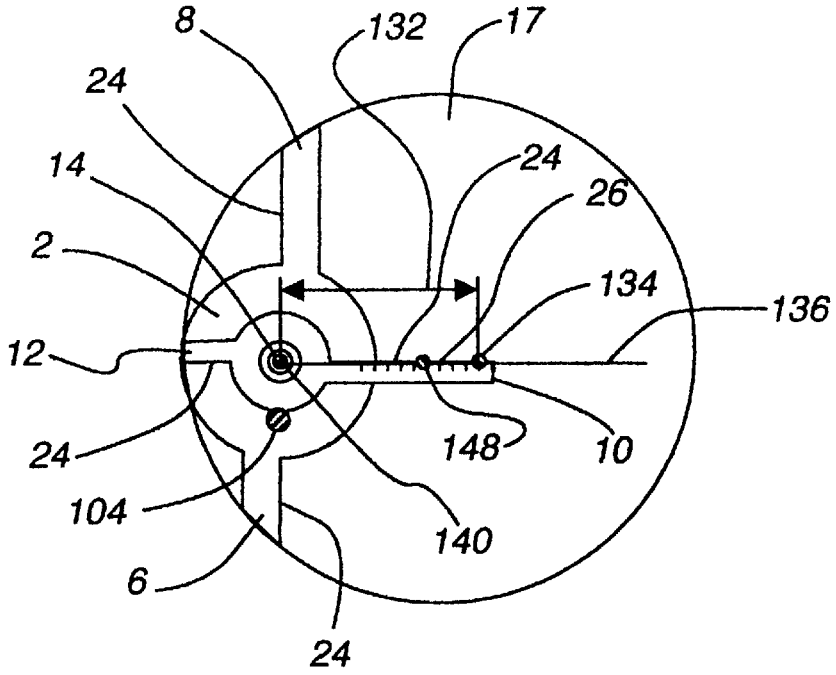
FIG. 28 illustrates a method for locating the grip center (GC) on an undrilled bowling ball along the centerline (CL) of the bowler's grip.

FIG. 28 illustrates a method for determining the grip center 134 of an undrilled bowling ball 17. After determining the location of the I-point 140 and drawing the midline 136, the center 134 of the bowling ball 17 grip can be determined. The user positions the angulator device 2 center hole 14 over the I-point 140 with the length indicator edge 24 of one of the indicator arms 10 extending along the midline 136. The user next marks the surface of the bowling ball 17 at a distance equal to a given PAP horizontal coordinate 132 using the length measurement indicators 26 on the indicator arm 10 that is aligned with the midline 136. This mark represents the location of the center of the bowling ball grip or grip center (GC 134).

Figure 29:
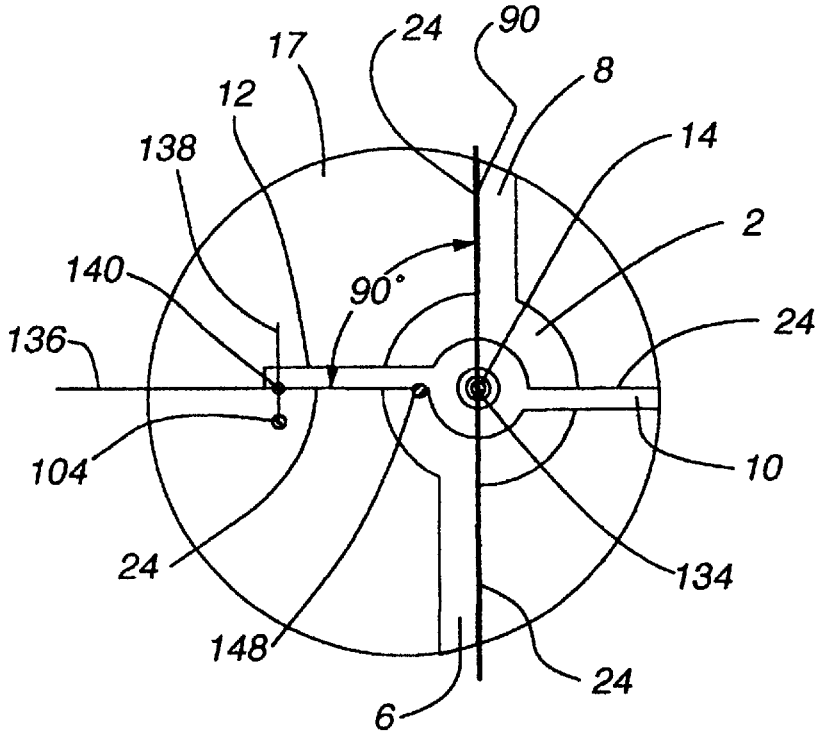
FIG. 29 illustrates a method of locating the grip centerline (CL) on an undrilled bowling ball.

FIG. 29 illustrates a method for locating and marking the centerline 90 of the bowling ball 17 grip on an undrilled bowling ball 17. The user places the angulator device center hole 14 over the grip center mark 134 with the length indicator edge 24 of one of the adjustable indicator arms 12 extending through the I-point 140 and the fixed indicator arms 6, 8 positioned at 90° offset from the adjustable indicator arms 6, 8. Next, the user draws a line 90 along the length indicator edges 24 of the fixed indicator arms 6, 8. The user then uses any one of the indicator arms to extend the line 90 completely through the grip center 134. This line represents the centerline of the grip 90. The centerline of the grip 90 is perpendicular to the midline 136.

The layout device of the present invention has been described herein, and provides for convenient, accurate and repeatable layout of a bowling ball, as well as assisting in the diagnostics of the important features and characteristics of a bowling ball.

Presently preferred embodiments of the present invention and many of its improvements have been described with a degree of particularity. It should be understood that this description has been made by way of example, and that the invention is defined by the scope of the following claims.

I claim:

1. A method for measuring a thumb aperture angle on a drilled bowling ball, said method comprising the following steps:

(a) providing a bowling ball having an exterior surface with finger apertures and a thumb aperture drilled therein;

(b) placing a user's thumb inside said thumb aperture;

(c) marking on sides of said thumb aperture where the sides of said user's thumb touch said thumb aperture;

(d) placing a straight edge on said exterior surface of said bowling ball from a first marked side of said thumb aperture to a second marked side of said thumb aperture and extending said straight edge;

(e) drawing a first line from a marked side of said thumb aperture closest to said finger apertures along said straight edge;

(f) placing a straight edge on said exterior surface of said bowling ball from the center of said thumb aperture closest to said finger apertures through the center of said surface between said finger apertures;

(g) drawing a second line from the center of said thumb aperture closest to said finger apertures along said straight edge and through the center of said exterior surface between said finger apertures; and (h) measuring an angle between said first line in step (e) and said second line in step (g).

2. A method for marking a thumb aperture angle on an undrilled bowling ball, said method comprising the following steps:

(a) providing a bowling ball having an exterior surface with a thumb aperture center and a grip centerline marked thereon;

(b) rotating about said thumb aperture center a given thumb aperture angle degrees from said grip centerline;

(c) creating a mark on said exterior surface of said bowling ball to indicate said given thumb aperture angle degrees from said grip centerline;

(d) placing a straight edge on said exterior surface of said bowling ball from said thumb aperture center to said mark in step (c);

(e) drawing a line on said exterior surface of said bowling ball from said thumb aperture center to said mark in step (c); and (f) extending said line on said exterior surface in an opposite direction than that drawn in step (e).

3. A method for locating a positive axis point of a drilled,bowling ball, said method comprising the following steps:

(a) providing a bowling ball;

(b) rolling said bowling ball down an oiled lane;

(c) marking a track defined by oil from said oiled lane on said bowling ball;

(d) placing said bowling ball on a surface such that a plane defined by said track is parallel to said surface and said track is as close to said surface as possible; and (e) locating said positive axis point by finding a spot on a portion of the bowling ball farthest away from said surface that is equidistant to at least three points on said track.

4. A method for measuring a bowling bowl positive axis point vertical coordinate, said method comprising the following steps:

(a) providing a bowling ball including an exterior surface having a grip center, a centerline of a grip, and a positive axis point marked thereon;

(b) drawing a first line perpendicular to said centerline on said bowling ball starting from the grip center and extending toward and beyond said positive axis point;

(c) drawing a second line perpendicular to said first line in step (b) starting at said positive axis point and extending to said first line in step (b);

(d) marking an intersection of said first line and said second line from steps (b) and (c);

(e) measuring a distance of said second line from step (c) starting from said positive axis point to said intersection in step (d).

5. The method in claim 4, wherein:

a vertical distance is negative if said second line in step (c) extends toward a thumb aperture end of said grip.

6. The method in claim 4, wherein:

a vertical distance is positive if said second line in step (c) extends toward a finger apertures end of said grip.

7. A method for measuring a bowling bowl positive axis point horizontal coordinate, said method comprising the following steps:

(a) providing a bowling ball including an exterior surface having a grip center, a centerline of a grip, and a positive axis point marked thereon;

(b) drawing a first line perpendicular to said centerline on said bowling ball starting from the grip center and extending toward and beyond said positive axis point;

(c) drawing a second line perpendicular to said first line in step (b) starting at said positive axis point and extending to said first line in step (b);

(d) marking an intersection of said first line and said second line from steps (b) and (c); and (e) measuring the distance of said first line in step (b) starting at said intersection in step (d) to said grip center.

8. The method in claim 7, wherein:

a horizontal distance is measured to the right of said intersection in step (d) if a bowler bowls left handed.

9. The method in claim 7, wherein:

a horizontal distance is measured to the left of said intersection in step (d) if a bowler bowls right handed.

10. A method for measuring a block angle of a drilled bowling ball, said method comprising the following steps:

(a) providing a bowling ball including an exterior surface having a center of gravity, a pin, and a positive axis point marked thereon;

(b) drawing a first line on said exterior surface from said pin to said center of gravity;

(c) drawing a second line on said exterior surface from said pin to said positive axis point; and (d) measuring an angle between said first line in step (b) and said second line in step (c).

11. A method for placing a positive axis point of an undrilled bowling ball, said method comprising the following steps:

(a) providing an undrilled bowling ball having an exterior surface with a pin and a center of gravity marked thereon;

(b) providing a block angle and a desired pin distance from the pin to the positive axis point;

(c) drawing a first line on said exterior surface from said pin to said center of gravity;

(d) rotating about said pin from said center of gravity a distance equal to a number of degrees in said block angle;

(e) creating a mark on said exterior surface of said bowling ball where said distance in step (d) is equal to the number of degrees in said block angle;

(f) drawing a second line on said bowling ball from said mark in step (e) to said pin;

(g) measuring from said pin to a point along said second line in step (f) that is a distance equal to said desired pin distance from said pin; and (h) marking a location of said point in step (g) on said exterior surface of said bowling ball.

12. The method of claim 11, wherein said exterior surface includes a mass bias marked thereon and said mass bias is used in place of said center of gravity in steps (c) and (d).

13. A method of placing a positive axis point intersection point of an undrilled bowling ball, said method comprising the following steps:

(a) providing an undrilled bowling ball having an exterior surface with a center of gravity and a positive axis point marked thereon;

(b) providing a positive axis point vertical coordinate;

(c) locating a point at a distance equal to said vertical coordinate from said positive axis point;

(d) marking said point in step (c) as the positive axis point intersection point;

(e) drawing a first line from said point in step (c) to said positive axis point; and (f) drawing a second line from said point in step (c) to an area of said bowling ball that will become a grip center; wherein said second line in step (f) is perpendicular to said first line in step (e).

14. A method of locating a center of a grip of an undrilled bowling ball, said method comprising the following steps:

(a) providing an undrilled bowling ball having an exterior surface with a center of gravity, a positive axis point intersection point, and a positive axis point marked thereon;

(b) providing a positive axis point horizontal coordinate;

(c) locating a point on said bowling ball a distance equal to said horizontal coordinate from said positive axis point intersection point; and (d) marking said point in step (c) as the center of said grip.

15. A method for locating a grip centerline on an undrilled bowling ball, said method comprising the following steps:

(a) providing an undrilled bowling ball having an exterior surface with a center of a grip and a positive axis point intersection point marked thereon;

(b) drawing a first line from said positive axis point intersection point to said center of said grip; and (c) drawing a second line perpendicular to said first line in step (b) and through said center of said grip.

* * * * *